US007988510B2

(12) United States Patent
Beltrani

(10) Patent No.: US 7,988,510 B2
(45) Date of Patent: Aug. 2, 2011

(54) FLIPPER

(75) Inventor: Giovanni Battista Beltrani, Genoa (IT)

(73) Assignee: Technisub S.p.A., Genova (IT)

( * ) Notice: Subject to any disclaimer, the term of this patent is extended or adjusted under 35 U.S.C. 154(b) by 0 days.

(21) Appl. No.: 12/300,881

(22) PCT Filed: May 16, 2007

(86) PCT No.: PCT/IB2007/001333

§ 371 (c)(1),
(2), (4) Date: May 22, 2009

(87) PCT Pub. No.: WO2007/135550

PCT Pub. Date: Nov. 29, 2007

(65) Prior Publication Data

US 2010/0003874 A1 Jan. 7, 2010

(30) Foreign Application Priority Data

May 16, 2006 (IT) ..... TO2006A0355

(51) Int. Cl.
*A63B 31/08* (2006.01)

(52) U.S. Cl. ..... 441/64

(58) Field of Classification Search ..... 441/55, 441/60–64

See application file for complete search history.

(56) References Cited

U.S. PATENT DOCUMENTS

| | | | | |
|---|---|---|---|---|
| 1,607,857 | A | | 11/1926 | Zukal |
| 2,094,532 | A | | 9/1937 | Glad |
| 2,343,468 | A | | 3/1944 | Messinger |
| 3,171,142 | A | | 3/1965 | Auzols |
| 3,256,540 | A | | 6/1966 | Novelli |
| 3,302,223 | A | | 2/1967 | Ciccotelli |
| 3,315,286 | A | | 4/1967 | Brion |
| 4,209,866 | A | * | 7/1980 | Loeffler ..... 441/64 |
| 4,300,255 | A | | 11/1981 | Beuchat |
| 6,126,503 | A | | 10/2000 | Viale et al. |

FOREIGN PATENT DOCUMENTS

| | | | |
|---|---|---|---|
| EP | 1127589 | A1 | 8/2001 |
| EP | 1127589 | B1 | 5/2006 |
| FR | 2455905 | | 12/1980 |
| FR | 2480129 | | 10/1981 |
| FR | 2565498 | A1 * | 12/1985 |
| GB | 2392388 | A | 3/2004 |
| WO | WO 01/85267 | A2 | 11/2001 |
| WO | WO 01/85267 | A3 | 11/2001 |

OTHER PUBLICATIONS

International Search Report for corresponding International Application No. PCT/IB2007/001333 dated Aug. 27, 2007.
Written Opinion for corresponding International Application No. PCT/IB2007/001333 dated Aug. 27, 2007.

* cited by examiner

*Primary Examiner* — Daniel V Venne
(74) *Attorney, Agent, or Firm* — Heslin Rothenberg Farley & Mesiti P.C.; Victor A. Cardona, Esq.

(57) ABSTRACT

A flipper for swimming or underwater activities or muscular training, includes a blade and a shoe, the ends of which facing one another are dynamically and kinematically separate. The blade has extensions projecting backwardly and fixed to the shoe in areas substantially corresponding to its central part. Elastic tier rods are provided between the blade and the front part of the shoe and are designed to control angular variations between the blade and the shoe.

5 Claims, 21 Drawing Sheets

FLIPPER

CROSS REFERENCE TO RELATED APPLICATIONS

This application is a national stage of PCT International Application No. PCT/IB2007/001333, filed on May 15, 2007, and published in English on Nov. 29, 2007, as WO 2007/13550 A1, which claims priority from Italian Patent Application No. TO2006A000355, filed on May 16, 2006, the entire disclosures of which are incorporated herein by reference.

FIELD OF THE INVENTION

The present invention relates to flippers for swimming or for underwater activities or muscular training, of the type comprising a blade and a shoe connected to the blade and defining the housing for a foot of the user.

STATE OF THE PRIOR ART

The operation of a flipper for swimming, moved by a human motor in reciprocating motion, is particularly complex. A flipper may be defined as "a reciprocating propeller with a geometry elastically varied by the reaction of the fluid".

The variation of geometry is essential for the blade, at each instant and in each area thereof, to assume an elastica suitable for impacting the water at a useful angle: each individual mass of water should be pushed backwards (propulsive effect) and not upwards and downwards (which would cause a braking effect on the motion of the foot). The deflection is induced by the inertia of the mass of water to be moved.

Since it is a reciprocating motion, it is essential that the flipper system should have an extremely high elastic efficiency. The energy of deformation absorbed at each kick, as the kick ceases, must be returned integrally, in a propulsively effective way. Systems with imperfect elasticity lead to an extremely low level of performance.

The flippers according to the prior art are all imperfect. All involve a considerable effort before the fluid has set them in an elastica useful for propulsion, because they must displace considerable braking masses of water. All of said flippers are based upon elastic systems with extremely low efficiency because they are made of materials traditionally selected not for being accumulators of energy but for forming blades or shoes of flippers, and none of them enable an adjustment that will allow the swimmer to vary and modulate the modes of transmission of power from his leg to the water.

In the sector of flippers, a truly complex problem is the evaluation of the efficiency of the flipper, either with an theoretical approach of calculation or by means of an empirical approach based upon experiments, where by "efficiency" is meant the ratio between the swimming speed reached and the effort required of the swimmer, namely, in less intuitive terms, the ratio between the kinetic energy obtained and the muscular energy that is required of the swimmer.

A first approach may be attempted by dividing the entire surface of the blade of the flipper into elementary fractions, designated in the ensuing text by "cmq" and observing the angle that the surface of each elementary fraction "cmq" forms with the "flow of water" vector, which point by point and instant by instant impacts against the surface of the blade. This is represented in FIG. 1 of the annexed plates of drawings, in which the arrow "m" indicates the direction of swimming. The shoe of the flipper, designated by "s", moves in this case downwards, as indicated by the arrow "m". The blade "p" is deflected, receiving the thrust of the water according to the vectors V1, V2, V3 and V4. According to the angle of impact with the surface of the deflected blade, the contribution to propulsion changes. In particular, the vector V2, with an impact of the blade at an angle substantially of 90°, does not contribute to propulsion but only increases the effort made by the swimmer. The vector V1 even yields, in addition to the effort, a negative propulsion.

It is therefore intuitive that, for angles close to 90°, or even larger angles, the contribution to the advance of the swimmer will be low or even negative; extremely high, instead, will be the increase in the effort that the swimmer himself has to make. The best condition is for angles comprised between 75° and 30°. Instead, for angles between 30° and 0° the water will tend to slip over the surface of the blade, with a reduction in the effort but with a propulsive effect close to zero.

In traditional flippers, the blade and the housing of the foot were connected to one another as a single moderately flexible structure. Solutions widely represented by numerous known embodiments envisage: the case where the blade has a substantially flat structure, and the "sole" of the shoe constitutes the natural prolongation thereof backwards; or else the case where the blade also has conspicuous longitudinal ribbings, designed to guarantee an appropriate flexural behaviour thereof, and said ribbings proceed with continuity along the two sides of the foot, providing in a continuous way the connection between the blade, the tip of the foot, and the entire sole. In any case, with said solutions the area of the blade facing the tip of the foot was unable to achieve, under the thrust of the water, angular deflections sufficient for the angle of impact of the flow of water against the individual small fractions of surface of the blade to be close to 90°. The result was flippers with a very rigid flexural behaviour, which in water presented extremely low efficiency because at least 30% of the surface of the blade presented a conspicuous braking effect on the movement of the leg, and a very low propulsive effect. Indeed, in some cases, there was found a certain tendency towards negative propulsion. It is known that by swimming "badly" with very rigid flippers it is even possible to go backwards.

It was of very little purpose to diminish the general stiffness of the flipper: clearly, the extension of the area of impact at 90° decreased; however, in the median stretch of the blade and above all in the last third, angles of impact were reached that are too small, with the consequent tendency of the blade to slip in the flow of water, without providing any useful thrust. The ratio between propulsion and effort (which were both decreased) remained in this case around values of mediocre efficiency.

In an attempt to overcome drawbacks of the, so to speak, earliest flippers, different solutions, listed hereinafter, have been more recently proposed.

In a first known flipper, perforated areas are provided between the shoe and the blade, in the way schematically represented in FIG. 2. With an embodiment of this sort, however, there is not only created a serious discontinuity in the flow, which causes conspicuous vortices and effects of stalling that lead to a drastic drop in the hydraulic efficiency of the blade, but the structure surrounding the hole bestows stiffness of behaviour upon the shoe-blade system, so that the percentage of braking elementary fractions <<cmq>> remains high. Furthermore, the centroid of the blade, understood as point of application of the resultant vector of the hydraulic forces, proves to be at an enormous distance from the fulcrum of rotation (which, for the evaluation of the muscular effort, can be identified in the joint of the swimmer's hip), thus forcing the swimmer to make an extreme effort.

Moreover generally known is the solution of creating a flexibilized region in the area between the foot and the blade. In some cases, an example of which is represented by the flippers described in the document No. WO-01/85267, filed in the name of McCarthy, there has been recommended a thinning-out of the load-bearing section of the flipper, precisely in the area that constitutes the flexural connection between the housing of the foot and the rear end of the blade. This solution has resulted in very few practical embodiments: there is in fact a reduction in the effort required on the part of the user, but the propulsive efficiency drops drastically in so far as, by interrupting the "backbone" of the flipper, there is a well-nigh total interruption in the transmission of power from the motor, which is represented by the foot of the swimmer, to the propulsion member, which is the blade.

Also provided is a hinge connection between the shoe and the blade, for example as in the solution represented with reference to the known art in FIGS. 50 and 51 of the already cited document No. WO-01/85267 and corresponding to the flipper marketed by Mares S.p.A under the brand name "VOLO". This is a much more effective solution than the one proposed in WO-01/85267 in so far as it envisages the creation of a hinge connection between the front tip of the structure that houses the foot (i.e., the "shoe") and the rear end of the blade, so as to enable, when it intervenes, a minimal thrust of the water with an inclination of the blade of at least 10/15°. It likewise envisages the provision, rigidly fixed to the shoe, of two side arms that prolong forwards—towards the tip of the blade—the lateral structure of the shoe. These are practically rigid arms, which reach the sides of the blade in a position that is advanced by several centimeters with respect to the aforementioned shoe/blade hinge, and the fundamental function of which is that of limiting and recalling the deflection of the blade with respect to the shoe, by means of two tie-rods made of thermoplastic rubber formed at the moment of injection moulding in the rubber of the shoe, said tie-rods being normally relaxed and being tensioned only when the aforesaid deflection approaches the maximum values desired.

In this way, the "first third" of the blade is never able to exert a braking action on the motion of the leg, because under the initial thrust of the water the blade is deflected sufficiently for the angle of impact of the flow of water never to approach the deleterious value mentioned previously, thus remaining very far from 90°. Furthermore, the elementary surfaces "cmq" set themselves with angles of inclination favourable for guaranteeing an optimal propulsion without ever involving excessive effort.

Also this solution presents, however, a series of critical defects, summed up hereinafter:

a) the hinge leads to a break in the profile of the flipper, which is certainly not ideal for guaranteeing a hydraulically correct behaviour; the breaking of the lines of flow leads to the risk of vortices and areas of stalling;
b) the two arms, far advanced beyond the tip of the foot, in any case constitute an ample braking area;
c) the blade in its "first third" is markedly restricted, so that the corresponding thrust is sacrificed by the presence of the two side arms;
d) the area between the arms and the blade is geometrically perturbed, in a way certainly unsuitable for enabling a flow of water free from vortices; and
e) in the swimming cycle, which basically may be defined as a four-stroke periodic cycle—kick-up, reversal up/down, kick-down, reversal down/up—two ample areas of hysteresis are created, around the two phases of reversal, in which the blade of the flipper is not able to transmit power and, as it waits to be "ready to push", interrupts propulsion for a few instants.

Basically, the flippering, far from being pleasantly "round", presents instead two "idle" phases that are certainly not pleasant, giving the sensation of "jerky" flippering. Among other things, not only theoretical arguments but also practical experiments of swimming show how the negative influence on propulsion due to these two phases of hysteresis depends upon the goniometric ratio between the dead angle—which is always the same—and the angle of effective stroke, which depends each time upon the particular style of swimming adopted by the swimmer. In the case in point, flippers of the Mares "VOLO" type are suited only to a classic style of swimming, characterized by ample and powerful strokes, but altogether unsuited to the style with small and frequent strokes that is spreading rapidly among modern-day swimmers and scuba divers.

Other known solutions are mentioned hereinafter with the corresponding drawbacks.

U.S. Pat. No. 2,343,468 (Messinger, 1944): provided under the tip of the foot is a hinge (pivoting connection) between the shoe and a substantially rigid short blade. The hinge is set within a pocket which contains stroke-limiting elements that limit the angular range between the blade and the shoe. It is absolutely impossible for a flipper of this sort to function: the constraint of connection is pivoting instead of being fixed, so that during the motion between the two end positions there does not occur any transfer of energy. Since no elastic member is provided in said constraint, in said phase there is not even any storage of energy; only the presence of a wide dead angle is found, in which the effectiveness of propulsion is zero. Furthermore, the connection between the shoe and the blade occurs at the tip of the foot instead of at the centre of the foot, breaking the lines of flow with consequent vortices. The stiffness of the blade renders the assembly in practice ineffective.

U.S. Pat. No. 3,171,142 (Auzols, 1965): the flipper is markedly thinned-out according to a cross section located a little further forwards than the tip of the foot. There are consequently possible wide angular deflections between the two parts into which the hinge divides the flipper, for limiting which in a way adjustable as desired the inventor envisages moreover rough rigid members, such as an external cage of adjustable width. Undoubtedly, the wide angular deflections reduce the flippering effort involved, but also render the propulsive thrust close to zero. The utility of being able to adjust the amplitude of the dead angle is not clear. The efficiency of the flipper would be inevitably extremely low because the lines of flow are broken on account of the broken geometry of the blade, the hydraulic friction of the cage is very high, the dead angle (without either transfer of energy or storage thereof in, on the other hand not envisaged, elastic members) is so preponderant in the useful phases to prove lethal for propulsive effectiveness.

U.S. Pat. No. 3,256,540 (Novelli, 1966): the flipper is made up of a shoe and a blade that proceeds backwards under the sole of the shoe, in the form of a second sole altogether free from the first, up to the heel of the shoe, connecting up to it precisely at the heel. Wide angular deflections are possible, but only during kick-down, so that the initial impact of the water on the blade at the start of the kick is damped and delayed. There follows a flippering which is certainly less tiring, but only during kick-down; it is, instead, altogether identical to a normal flipper, during kick-up. This, apparently interesting, effect is absolutely to be avoided. Said asymmetry of absorption of effort, and of propulsive effectiveness, is experienced as extremely deleterious for the purposes of flippering: in each instant, the right leg makes more effort than the left one or vice versa, the speeds of vertical translation of the feet go out of phase. The right foot, for example, arrives at the top dead centre long before the left one arrives at the bottom dead centre; consequently, the rhythm of flippering is broken. Means are provided, at the two sides of the shoe, which limit the amplitudes of deflection between the shoe and the blade, without, however, envisaging that they can be elastic and hence suitable for storing elastic energy at each cycle and returning it in a reactive way; consequently, the wide dead angle does not serve either to transmit energy from the shoe to the blade or to store it. On account of the above fundamental over-simplicity of conception, it is impossible for the efficiency of the flipper to be high.

Patent application No. EP-1127589A1 (Garofalo, 2001): the flipper is made up of a blade and a shoe, which proceeds forwards with two antero-protruding lateral appendages, which flank the rear area of the blade comprised between them. The blade and the shoe are connected to one another with continuity in the area of the tip of the shoe, either directly as prolongations of one another or else by means of a hinge set in front of the tip of the foot so that the rear end of the blade is forced to follow in its movements very closely, during the action of swimming, the motion of the tip of the shoe. Transverse elastic members connect, more or less elastically but with low elastic efficiency, the area of the blade comprised between the two antero-protruding lateral appendages of the shoe, with the tips of the appendages themselves.

Angular deflections are possible between the shoe and the blade (only in kick-down), but, owing to the geometrical continuity, the rear end of the blade is forced to follow closely the front tip of the shoe during the movements, thus rendering swimming much less "facilitated" than would be desirable both during kick-down and during kick-up. The elastic members described by Garofalo are clearly ineffective because they are shaped like thin ribbons so that their extremely small volume cannot in any way store the amount of energy desirable for considering them as energy accumulators or storage elements that absorb and restore the swimming energy at each cycle. The corresponding assembly described involves friction and rapid wear of the flippers. No adjustment of power is envisaged.

French patents Nos. FR-2480129, FR-2455905 and U.S. Pat. No. 4,300,255 (Beuchat): the blade is fixed under the sole of the shoe, so that the tip of the foot is quite free in kick-down, but not very free in kick-up. A large central ribbing stiffens, however, the first part of the blade, and consequently the possibilities of ample deflections between the front margin of the shoe and the first third of the blade are in actual fact extremely small. No separation or gap is provided between the first third of the shoe and the blade. No return member is provided between the tip of the shoe and the blade.

U.S. Pat. No. 6,126,503 (Viale/Garofalo, 2000): the flipper is constituted by a shoe and by a stiffer blade, the shoe being provided with two antero-protruding lateral projections (i.e., protruding towards the end of the flipper). The shoe is connected to the blade by means of a hinged constraint with transverse axis, set in the area comprised between the two front lateral protuberances of the shoe. The blade is then connected further, by means of two elastic members, to the front ends of said protuberances of the shoe. The behaviour is ineffective for considerations similar to the ones referred to above with reference to the document No. EP-1127589A1.

In a new recent type of flipper, publicised in magazines and exhibited at EUDI in March 2006, the blade, instead of being set in a position corresponding to the natural prosecution forwards of the shoe, is positioned much further upwards—by approximately 10-15 cm—in such a way that the user, once out of the water, can walk upright without the blade touching the ground, and when he is swimming prone on the surface of the water the blade will always remain completely submerged. In this innovative type of flippers, the connection between the shoe and the blade is formed by means of two side arms protruding backwards from the blade, which, however, do not prolong simply behind the lateral ribbings thereof, but drop downwards with a sharp inclination, to recover the difference in level of approximately 20 cm between the blade and the foot. These also are connected to the shoe towards its central area, slotting thereinto. Elastic-return members are not envisaged so that the geometry of the three fulcra, which will be described in what follows, is not implemented or possible. Furthermore, the rear edge of the blade and the tip are exaggeratedly distant from one another, by approximately between 10 cm and 20 cm. Said unusual characteristic enables passage of an enormous flow of water that is not used between the shoe and the blade, drastically reducing the propulsive effect of the flipper. Finally, the axis of the propulsive thrust is markedly misaligned from the axis of swimmer's body, causing a high deviating torque at each swimming action. Even though it is possible for a particularly expert swimmer to eliminate or reduce said deviating effect with an appropriate but forced inclination of the body, the result is a marked braking effect. It is a propulsive situation altogether similar to that of a motorboat with two propellers, the right one of which is blocked: it is obvious that the motorboat will tend to turn to the right. A correction of the helm (blade to left) will correct the course, but navigation will be markedly slowed down.

SUMMARY OF THE INVENTION

The object of the invention is to overcome the drawbacks described above of known flippers, and said purpose is achieved thanks to the characteristics defined in Claim 1 and in the subsequent claims subordinate thereto.

In brief, the flipper forming the subject of the invention is basically made up of two clearly distinct parts, the shoe and the blade. The first is usually defined as "shoe" in so far as it constitutes the housing for the foot and comprises soft and elastic parts for accommodating the foot comfortably, with the part of heel at the rear closed or else open and in the latter case equipped with strap and buckle systems for adjustment and possible fast release thereof. It likewise comprises a rigid basic structure designed to transmit the power from the leg to the blade.

The blade is the propulsion member proper: albeit substantially flat and flexible, it can include areas with complex geometry, stiffening ribbings, eyelets, or slits or notches, membranes, bellows, channels, areas of variable geometry, bladings, valves, scoops and any type of functional structure. It can be made of rigid-flexible material EVA, PP, PC, PA, etc., or else of elastomeric material, or else again of a mixed rigid/flexible/soft composition.

The blade is located in front of the tip of the shoe and is connected thereto in an innovative and original way, which constitutes a first peculiar aspect of the invention. The blade is in fact not rigidly connected to the front part of the shoe and does not at all constitute the front prolongation thereof, but is separated therefrom by a cut so as to form a gap with a width as small as possible, consisting in an area generally without any material, for example shaped substantially like a horseshoe. It is consequently a generally empty area that surrounds the entire front tip of the shoe and proceeds towards the heel also along the two lateral edges of the shoe itself, until it is interrupted not before having reached the central area of the foot. If we imagine dividing the foot ideally into three parts, the connection between the blade and the shoe is made only in the central third part (and possibly also in the rear third part, or else only therein).

In other words, the above characteristic may be expressed by saying that in the present invention the shoe and the blade of the flipper must be disconnected in the area facing the front part of the shoe and in the areas of its sides, transferring the connection to an area, symmetrical on the two sides, located approximately in the central area of the foot and possibly in the rear area.

Branching off from the blade are two rear arms projecting backwards, which are rigidly connected to the blade itself and flank the entire front part of the shoe without coming into contact therewith. Said two arms proceed backwards approximately up to the central third part of the foot, and here they are structurally connected to the structure of the shoe itself.

The result is that, during the action of swimming, under the thrust of the water the blade bends independently of the shoe for even very wide angles of deflection. The tip of the shoe will be pushed by the force of the swimmer much further upwards (or downwards), but the blade in its "first third" will not be forced to remain aligned thereto. Each of its elementary fractions—or fractions of surface "cmq" introduced previously—will present to the flow of water an angular orientation altogether distant from 90° also in the first third of the blade. The resulting effect, for the reasons explained previously, is a use of the flipper that is in no way at all tiring.

FIG. 3 provides a schematic comparison between a flipper according to the prior art cited previously, in which the shoe is directly connected to the blade and a flipper characterized by the first aspect analysed above. In the first case, a first braking area of the blade is identified in so far as the blade is directly connected to the shoe, whereas in the second case the braking area does not exist and the blade exerts thrust throughout its surface. In the traditional flipper, in fact, the blade is a prosecution of the flexural structure of the shoe, and since it is the natural prosecution thereof, is very rigid in the area of connection. When the foot is displaced downwards (kick-down), the terminal area of the blade assumes an obtuse angle of impact with the water, which is consequently favourable. The mass of water corresponding thereto is propelled backwards, thus guaranteeing propulsion. However, at the same time, the mass of water corresponding to the area of joining between the blade and the shoe is displaced downwards with considerable force, for a long stretch, with the effect of absorbing a considerable muscular effort not accompanied by any propulsive effect. The propulsion/effort efficiency is consequently extremely low.

In the flipper according to the invention it is important, in order for the propulsive effect not to be altogether inadequate, for there to be correct adjustment of the flexibility not only of the blade, but also, and even more important, of the two side arms. Entrusted to them in fact is, in this first aspect of the invention, not only the geometrical connection between the shoe and the blade, but also the elastic response of the system, which must, at each half-cycle, deflect into the new elastica, to charge itself with elastic energy, and guarantee propulsion, and during the subsequent phase of reversal must then return the energy stored with the maximum possible efficiency.

The first peculiar aspect of the invention can hence be summed up as follows: connection between the blade and the shoe only at the centre of the foot.

In accordance with a second peculiar aspect, the invention solves with extreme effectiveness, and in a way complementary with the aspect described in the previous paragraph, the problem of transmission of energy from the shoe to the blade. This occurs, in a way that is appropriately modulated through the various micro-phases into which each phase of the cycle may be broken down, via innovative members that may be defined as "energy-storage elements", made up of a material presenting an elastic behaviour exceptionally close to the theoretical one, and in which—at the start of each kick—elastic energy is stored ready to be immediately and violently discharged on the mass of water as soon as the kick ceases, thus guaranteeing continuity of propulsion even during the phases of reversal of the kick, as well as extremely prompt return to the elastica most appropriate for the next kick.

With reference to FIG. 4, which illustrates a side view of the flipper represented schematically and projected on the plane of symmetry, the "theory of the three fulcra" will now be examined; i.e., three kinematic nodes or fulcra designated by (A), (B), (C) may be identified.

The first (A) is ideally located at the centroid of the fixed joint between the rear arms of the blade and the central segment of the shoe.

The second (B) is located at the front tip of the shoe and corresponds to two pins, which are arranged on the right and on the left of the tip of the shoe itself, so that they project therefrom in the empty area that will be described in what follows and to which, with appropriate pre-tensioning, the elastic tensile members are anchored.

The third (C) is located on the plane of the blade, for example approximately 10 cm towards the tip of the blade itself, and corresponds to two couplings arranged symmetrically on the blade for the aforesaid elastic tensile members.

With reference to FIG. 5, it emerges that, when the flipper is in zero elastica, the three points A, B and C are aligned. When, instead, the flipper is deflected, the alignment between the three points is lost and, moreover, the distance between point B and point C increases, following a approximately parabolic non-linear law; i.e., it increases very little for small angles of deflection and a great deal for large angles.

In actual fact, between the two pins coinciding with the aforementioned fulcrum B, and the two couplings coinciding with the fulcrum C, two elastic tie-rods are mounted and set in tension, free to rotate around the respective pin and the respective coupling.

During the action of swimming (FIG. 6), when the blade is deflected the distance between the fulcra B and C increases. The elastic tie-rods transmit a reaction that initially follows Hooke's law, progressively increasing gradually and continuously.

This excludes the jerky operation of the system described with reference to the Mares "VOLO" flipper. Furthermore, the line of action of said force, which in the undeformed situation of the flipper passes exactly through the first fulcrum A (consequently with zero arm of lever), as the deflection increases, an increasingly more powerful arm of lever is acquired in regard to the fulcrum of rotation. Consequently, the moment of return, which recalls the blade towards the "zero deflection" situation, is zero in the zero elastica. As the deflection progressively increases, the moment of return will increase first very little, then gradually more and more, and so on in progression until it becomes an unsurmountable obstacle to further deflections, as emerges from the diagrams of FIG. 7.

It is necessary to emphasize this non-proportionality of the moment of return, enabled by the second peculiar aspect of the invention discussed herein, constituted by the original geometry of the three fulcra described previously. It enables in fact levels of swimming efficiency far higher than those of the Mares "VOLO" solution: in fact, only with zero deflection is the return zero. The blade is deflected without any effort towards the "favourable angles" referred to previously, but immediately and progressively the return increases and rapidly becomes extremely marked, so much so as to render impossible any further deflections that would coincide with collapse of the structure of the flipper.

An absolute guarantee against structural collapse and drop in propulsion, which would occur in the case of exaggerated deflections (a collapse and drop that constitutes the problem that has remained unresolved in the prior art according to document No. WO-01/85267, cited previously), is constituted by the elastic curve characteristic of the material chosen for the return tie-rods. It is known in fact that, if for example, vulcanized silicone rubber or equivalent materials is used, with a lengthening greater than appropriate percentages and in any case adjustable by means of a careful formulation of the rubber, a fast sharp rise in the curve may be obtained, with the effect of blocking the maximum deflection tolerable between the shoe and the blade at the desired value.

The second peculiar aspect of the invention can thus be summed up as follows: presence of return members and theory of the three fulcra.

A third aspect of the invention is directly connected to the function of the return members and to the materials of which they are constituted. The function of the members or return tie-rods is multiple. In particular they must:

A) in the undeformed position, absolutely not hinder the deflection of the blade at the minimum kinetic pressure of the water;

B) progressively, as the deflection increases, oppose a modulated reaction thereto;

C) progressively charge themselves with elastic energy;

D) once the maximum deflection is reached, constitute a gentle limit that, however, cannot be exceeded;

E) at reversal of the kick, discharge promptly and integrally the energy stored therein.

The tie-rods must consequently be made of carefully selected and formulated elastic material to achieve the most advantageous elastic characteristics. It is possible, but not to be preferred except in the case of absolute need for economy, for it to be made of thermoplastic rubber, i.e., of the same material as the shoe in so far as thermoplastic rubber is not able to store energy and return it for an extremely large number of cycles, preserving an efficiency close to 100%. They would deform irreversibly owing to yielding, thus losing any effectiveness.

Consequently, clearly to be preferred is a vulcanized rubber or, for example, silicone rubber. For instance, silicone rubber that can be injection-moulded in the liquid state, reaching Shore D hardnesses comprised between 20 sh and 80 sh, in addition to absolute undeformablity after cyclic tensile and compressive stresses has the valuable peculiarity of behaving in a practically Hookean way up to a certain percentage of elongation, and then rapidly becoming practically inextensible, thus offering an extremely useful effect of limit to the maximum deflection tolerable between the shoe and the blade.

It is evident that the tie-rods will be, preferably but not necessarily, produced separately from the flipper and using the most appropriate material, and subsequently mechanically connected to the flipper or else, for example, by introducing them as inserts in the moulds in which the flipper is injection-moulded. Absolutely more advanced, however, is a solution whereby the tie-rods, which have previously been produced, are assembled on the flipper in a convenient and easily removable way, enabling the user to perform rapid replacement thereof, even without any need for tools, for the purpose of repair due to possible wear, or for interchanging them with other models, for example, with different elastic-tensile characteristics, which may be optionally distinguished by means of different colourings.

It is also possible to use tie-rods made of flexible plastic material, or else even metal, appropriately shaped like a spring, provided that they are designed in such a way as to perform the functions referred to above.

The system of connection described above (the theory of the three fulcra) enables the elastic tie-rods to work in a condition of pure tension. The effect of the tie-rods is exactly symmetrical in the two phases of kick-up and kick-down, and they are hence able to exert on the blade a force of return exactly symmetrical in the two phases.

This corresponds to a symmetrical use of the flipper according to the invention. Notwithstanding this, a creatively asymmetrical use (higher effectiveness of the invention in one kick, lower effectiveness in the other kick) could be suggested starting from three considerations of an anatomical and of a swimming nature:

a) the muscles used for swimming with flippers are undoubtedly more powerful in the phase of kick-down;

b) the ankle joint is markedly asymmetrical: during kick-up it enables discharge, as desired, of the effort; instead, during kick-down, the joint is no longer free and meets with a strong resistance, which may be painful;

c) when swimming on the surface, kick-up is far from propulsive because the mass of water pushed by the flipper can emerge from the surface.

A methodology that may be followed to adapt the invention to the need for asymmetry in the swimming effectiveness the reasons for which appear above, consists in interposing a further constraint upon the free movement of the elastic tie-rods: for instance, a rest, or a pulley or a stroke-limiting element, set either above each tie-rod or underneath it, in such a way as to affect, or else vary, the behaviour thereof only during kick-down or, alternatively, only during kick-up. A possibility in this sense is schematically represented in FIG. 8.

In brief, the present invention is distinguished, in a new and original way, as compared to the flippers according to the known art analysed previously, basically by one or more of the following general aspects:

the blade is equipped with two retro-protruding side arms, in the sense that from the sides of the blade they branch off in a backward direction towards the central area of the foot;

provided between the shoe and the blade is an area of connection markedly set back, constituted by a sturdy fixed constraint with the two sides of the side area of the foot between the centre of the shoe and the rear ends of the two arms of the blade referred to above;

defined between the shoe and the blade is an empty area, or in any case an area of dynamic and kinematic non-connection, for example generally in the form of a U-shaped gap that surrounds the entire front tip of the shoe and the two sides up to the centre of the foot, freeing the rear part of the blade from any kinematic and dynamic connection with the tip of the shoe;

the elastic connection members are able to transmit considerable stresses with high elastic efficiency so much so as to be able to be considered as "energy-storage elements", connected in a preferably dismantlable way and with adjustable tensioning between the area of the tip of the shoe, and the median region of the blade, and connected likewise to the blade and to the shoe in such a way as to transmit the flow of energy perfectly, without causing any wear to the parts involved.

DETAILED DESCRIPTION OF A PREFERRED EMBODIMENT OF THE INVENTION

Figure 1:
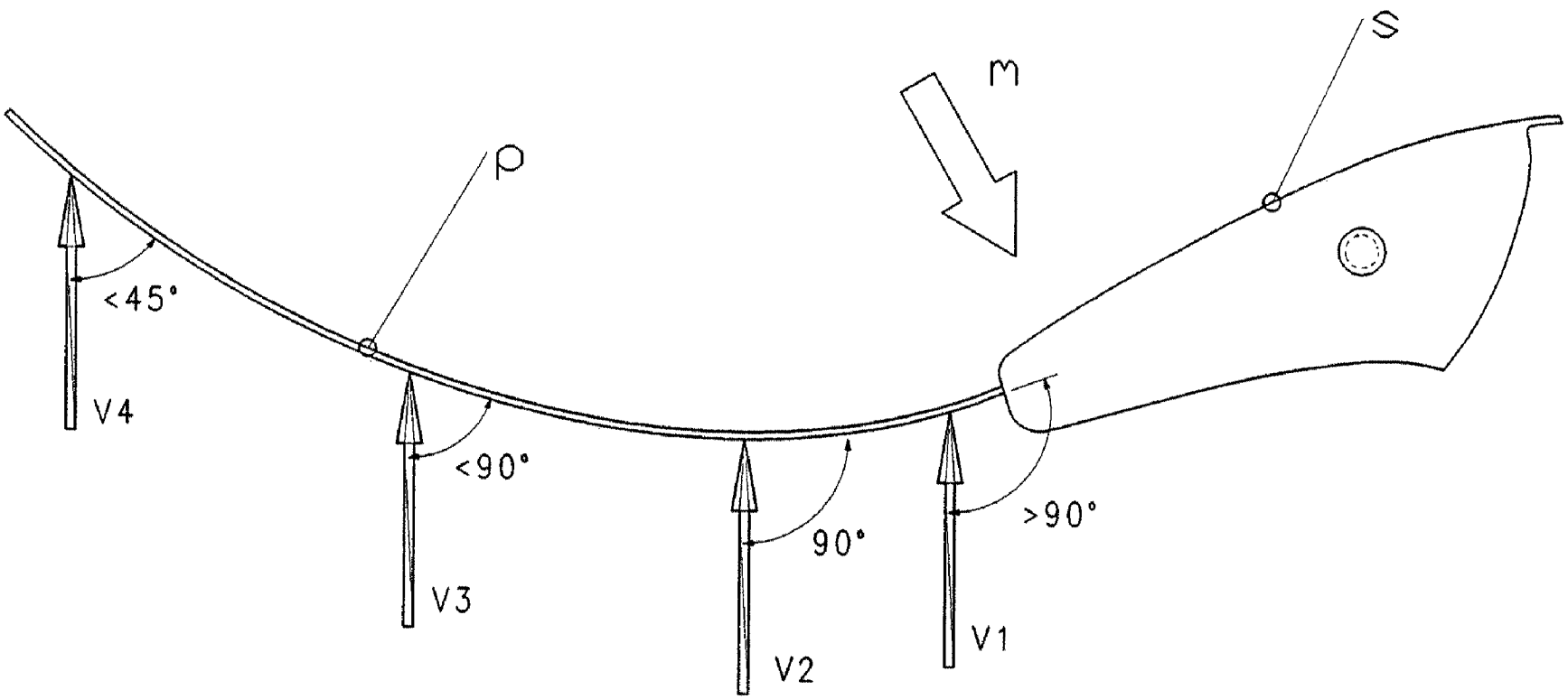
FIG. 1 is a schematic view in side elevation that exemplifies the functional behaviour of a first type of flipper according to the known art.
Figure 2:
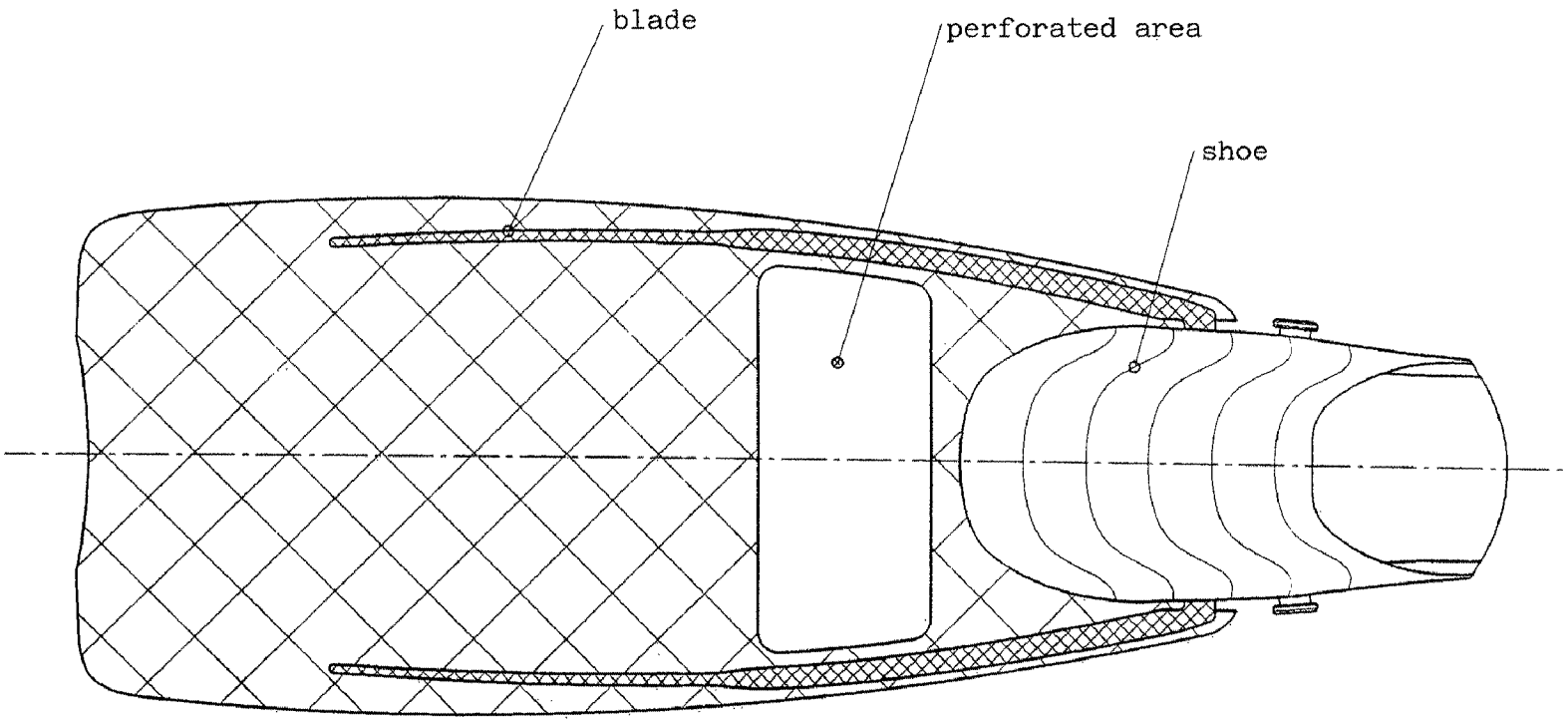
FIG. 2 is a schematic plan view that exemplifies another type of flipper according to the known art.
Figure 3:
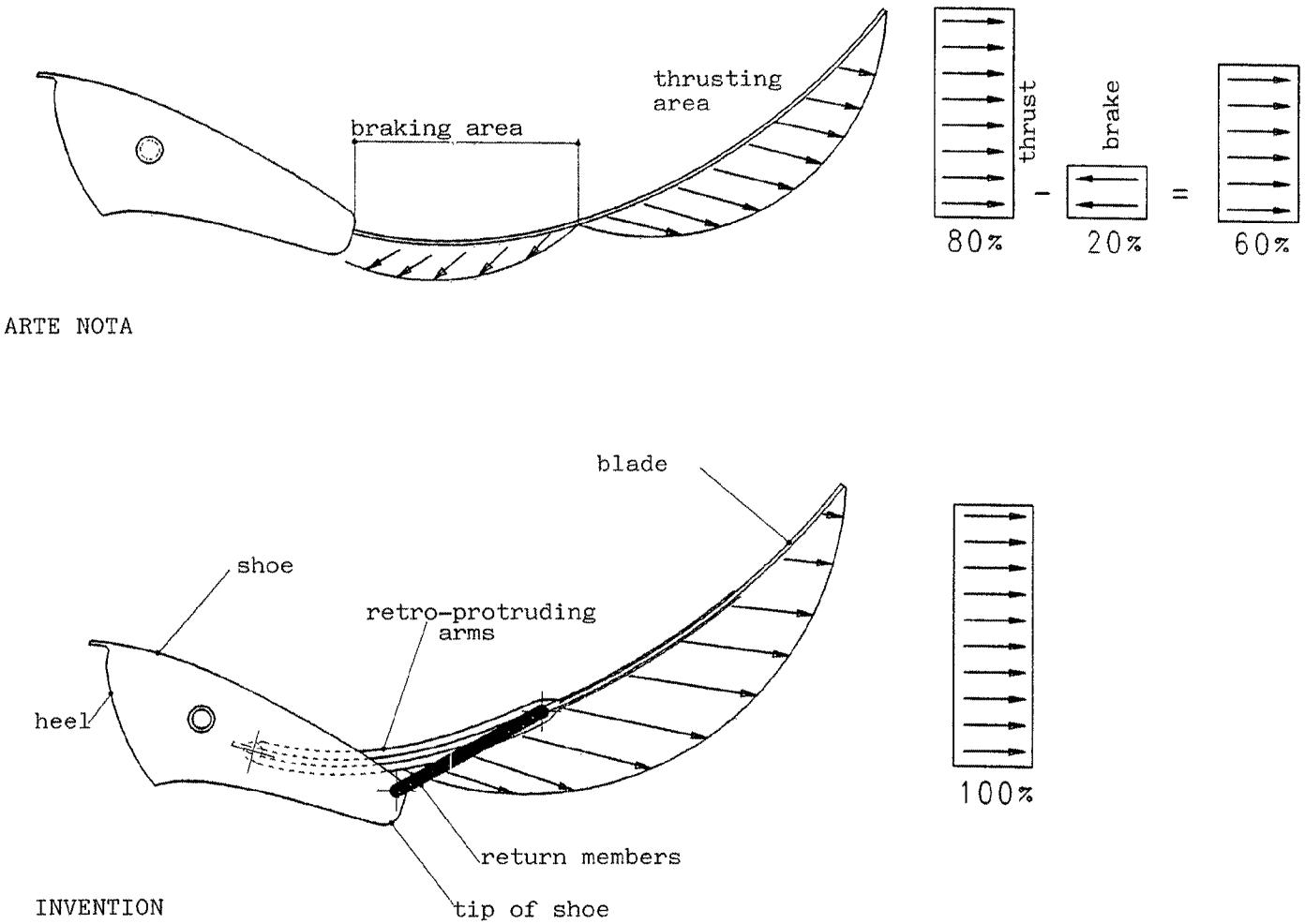
FIGS. 3 to 8 are schemes and diagrams that exemplify the theory underlying the present invention, as discussed previously.
Figure 4:
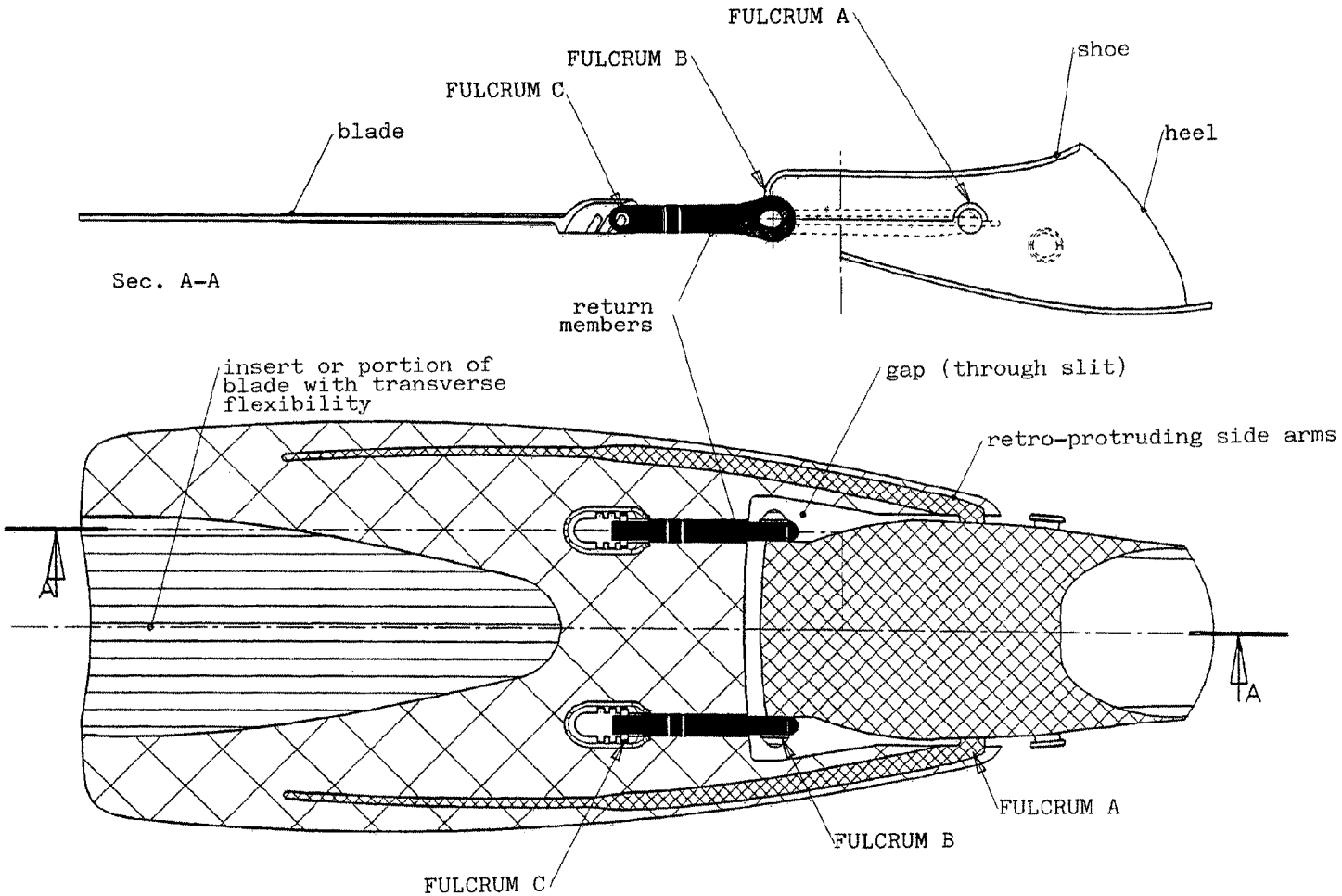

With reference now to FIGS. 9 to 12, a preferred practical embodiment of the invention will now be described.

The flipper comprises a shoe 1 and a blade 2.

The shoe 1, i.e., the member for housing the user's foot, is constituted by a rigid fairing 3, which performs the function of connection with the blade 1 and of transmission of energy from the leg to the blade 1, and by a soft part 4, which surrounds the foot and preferentially performs also the function of anti-slip innersole. The heel can be of the closed type without any strap ("fullpocket"), but in the case in point is represented as of an open type, designed to be completed with a strap and corresponding buckles, for example, of a fast-adjustment type, for anchorage of which opposed projections 5 are provided, which project from the opposite sides of the fairing 3.

The blade 2, for example represented herein as a multi-material structure, includes a substantially plane central area, made of rigid/flexible material (for instance, polypropylene (PP), ethylene vinyl acetate (EVA), polycarbonate (PC), polyamide (PA), etc.), in which areas 6 made of elastomeric material and possibly of other types of material can be included, for example in the form of flexibilizing bellows that enable the blade 1 to bend also transversely, to obtain particular effects of channeling or scooping of the fluid threads. The two lateral side pieces of the blade 1 can house two longitudinal elastic-stiffening ribbings 7, the so-called longitudinal members, which can be made of rigid/flexible material similar to that of the blade (PP, PC, PA, EVA, etc.) or else of elastomeric material, such as for instance thermoplastic rubber or other types of rubber. In the example proposed, the side ribbings 7 are of considerable thickness and are made of a particular type of thermoplastic rubber of the SEBS family, having the dual characteristic of adhering very firmly, by over-injection moulding, on the underlying rigid layer, and of being able to store elastic energy in large quantities and return it instantaneously in the two phases of reversal of the motion, so achieving an extremely high efficiency of elastic return. They can in any case present within them a skeleton made of flexible material with higher modulus of elasticity, aimed at reducing their elastic deformation under forceful impulses.

The thrusting part of the flipper, i.e., the centre-front portion of the blade 1, can be rendered more effective by means of use of a central area shaped like a bivalent scoop. Said area can be formed using particularly flexible materials possibly different both from the rubber of the shoe 2, in so far as they would be too limp and without elastic nerve and consequently not able to transmit power or discharge the elastic energy immediately, and from the plastic of the blade 1, than which they must be more flexible. For instance, to a blade made of polypropylene there would correspond advantageously a scoop-like insert made of elastomerized polypropylene or EVA with 12% vinyl acetate. To a blade made of EVA with 12% vinyl acetate (with high elastic modulus) there could correspond an insert made of EVA with 18% vinyl acetate (with low elastic modulus).

The higher flexibility of the scoop area may be obtained also, as in the particular embodiment described herein, by means of materials similar to those of the blade but provided with sections appropriately thinned-out along lines of programmed bending, or corresponding notches; said thinned-out areas or notches could possibly be consolidated but not stiffened by means of tongues made of thermoplastic rubber, which are adhesive to the substrate because they are made of a single piece with the shoe at the moment of injection-moulding thereof. The scoop itself could, for example, be welded to the body proper of the blade 1 simultaneously to this operation.

The function of the central bivalent-scoop insert is that of deflecting in the direction of the width, under the kinetic pressure of the water, forming a central concave area open towards the outlet end of the blade, said concave area being symmetrically displaced upwards in kick-down, and downwards in kick-up. Said morphology is able to convey the flow of water towards the end of the flipper, eliminating dispersions of lateral flow, and stabilize the flipper against the "skidding", or "sideslip" effect, thus exonerating, in use, the ankle of the wearer from the need to make an effort to resist torsional vibrations, which are so troublesome in flippers, the blade of which is characterized by a predominantly flat conformation.

The two lateral ribbings 7, which flank the two sides of the blade 1 from its front end up to the tip of the shoe, increasing progressively their own dimensions and hence also the moment of inertia of the sections, assume then the form and the function of lateral extensions or supporting arms 8 and proceed then further towards the heel until, once they have arrived in the proximity of the middle portion or central area of the shoe 2, in a position approximately equidistant from the tip and from the heel, they connect up to the rigid structure 3 of the shoe 2 via respective robust fixed-end joints 9. The strength of this connection is of fundamental importance in so far as it must be able to transmit the entire flow of energy from the human motor to the propeller, without undergoing problems of formation of cracks, fatigue stress, or ageing. A fixed-end joint is the preferential solution: alternatively, it is possible to propose a robust pivoting connection obtained by means of respective pins or fulcra. However, in this case, in addition to bigger mechanical problems, as well as problems of wear, there could arise problems of stability of the entire structure in so far as it would then have an excessive number of degrees of freedom.

Figure 9:
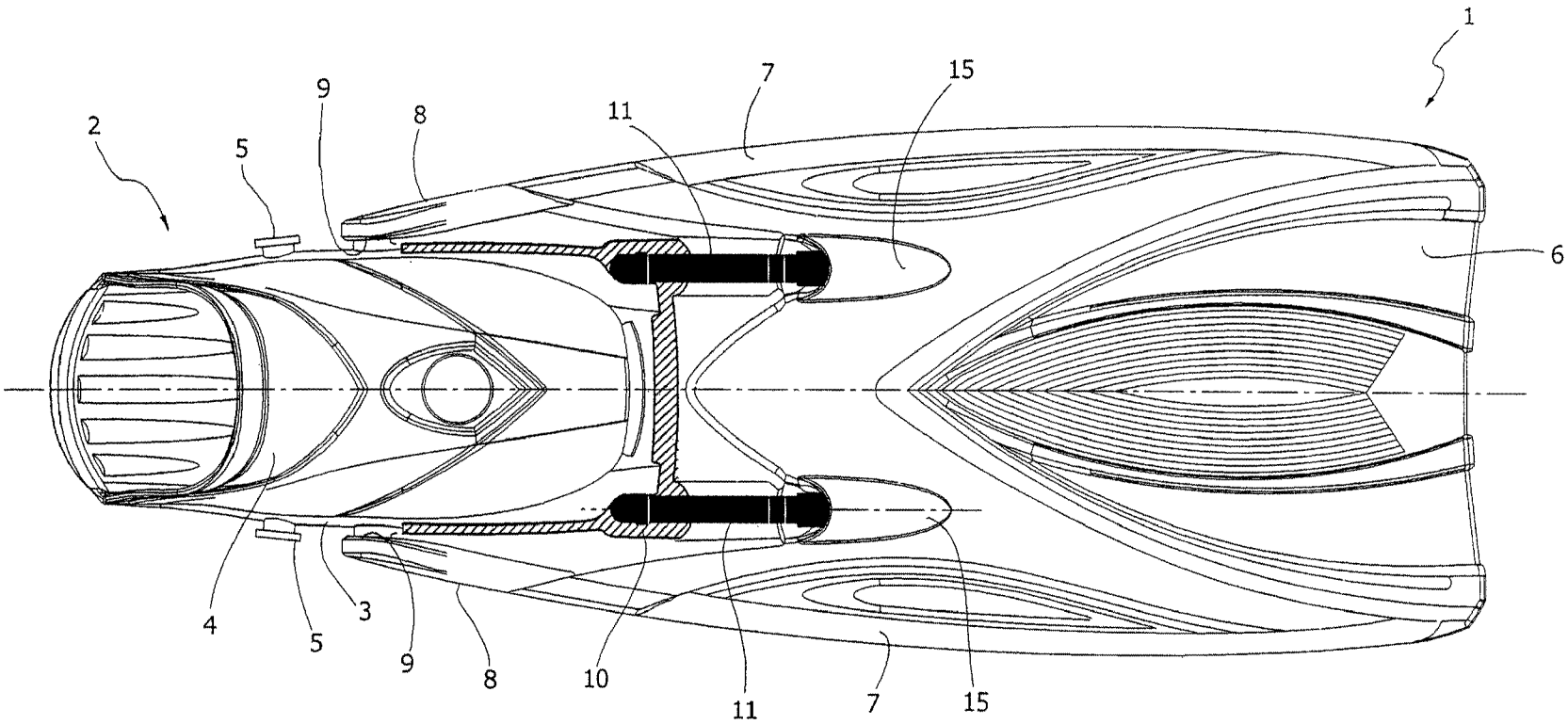
FIG. 9 is a top plan view of a preferred embodiment of the flipper according to the invention.
Figure 10:
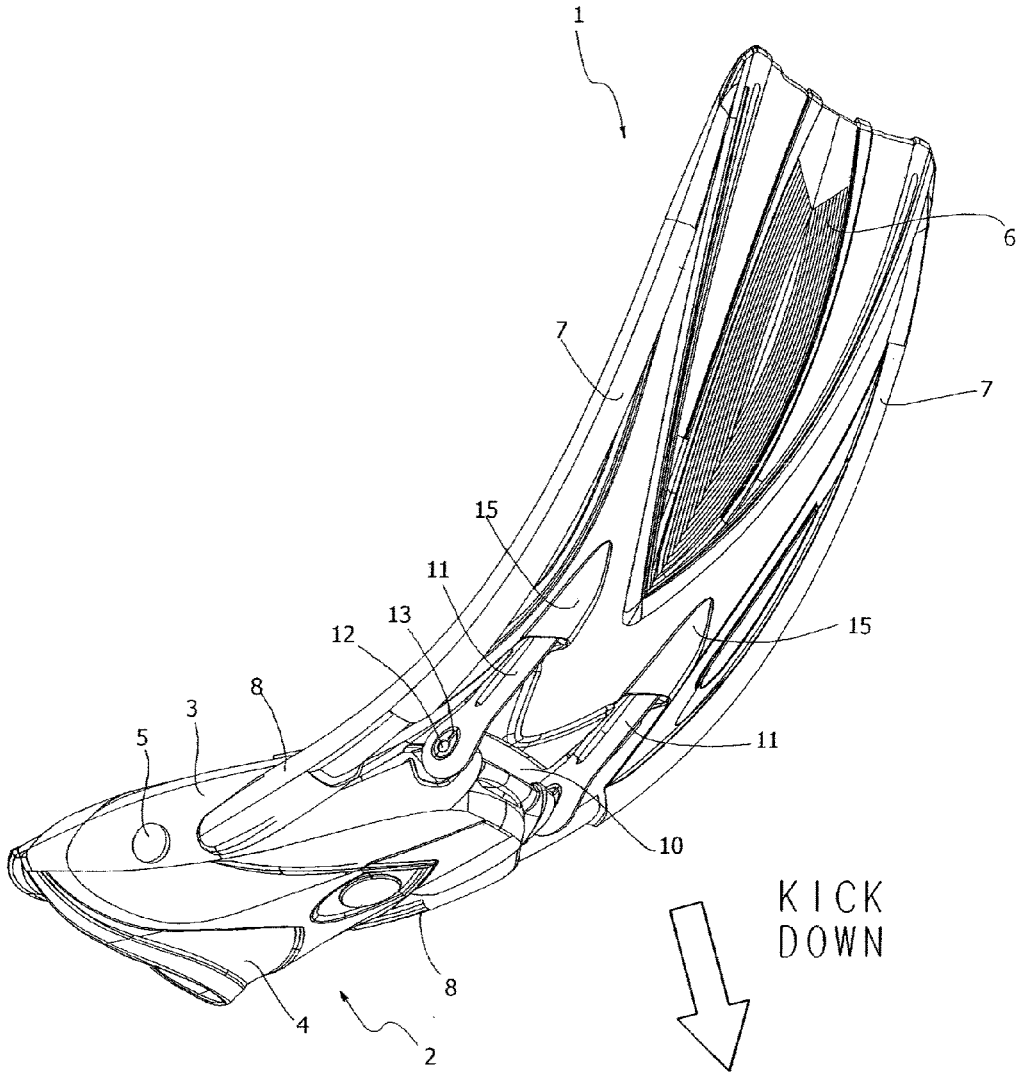
FIG. 10 is a perspective view that shows the flipper during the phase of kick-down.
Figure 11:
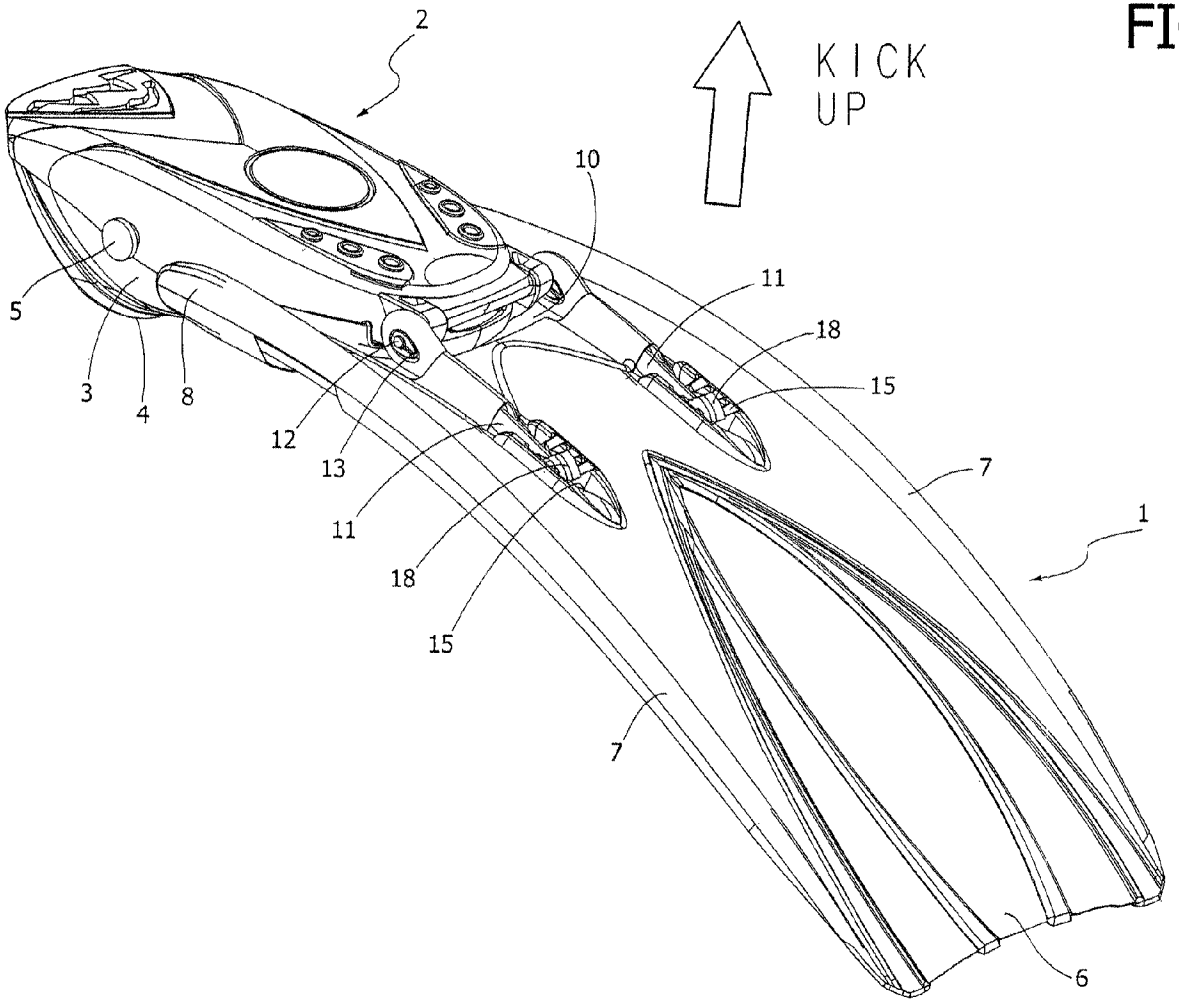
FIG. 11 is a perspective view that shows the flipper during the phase of kick-up.
Figure 12:
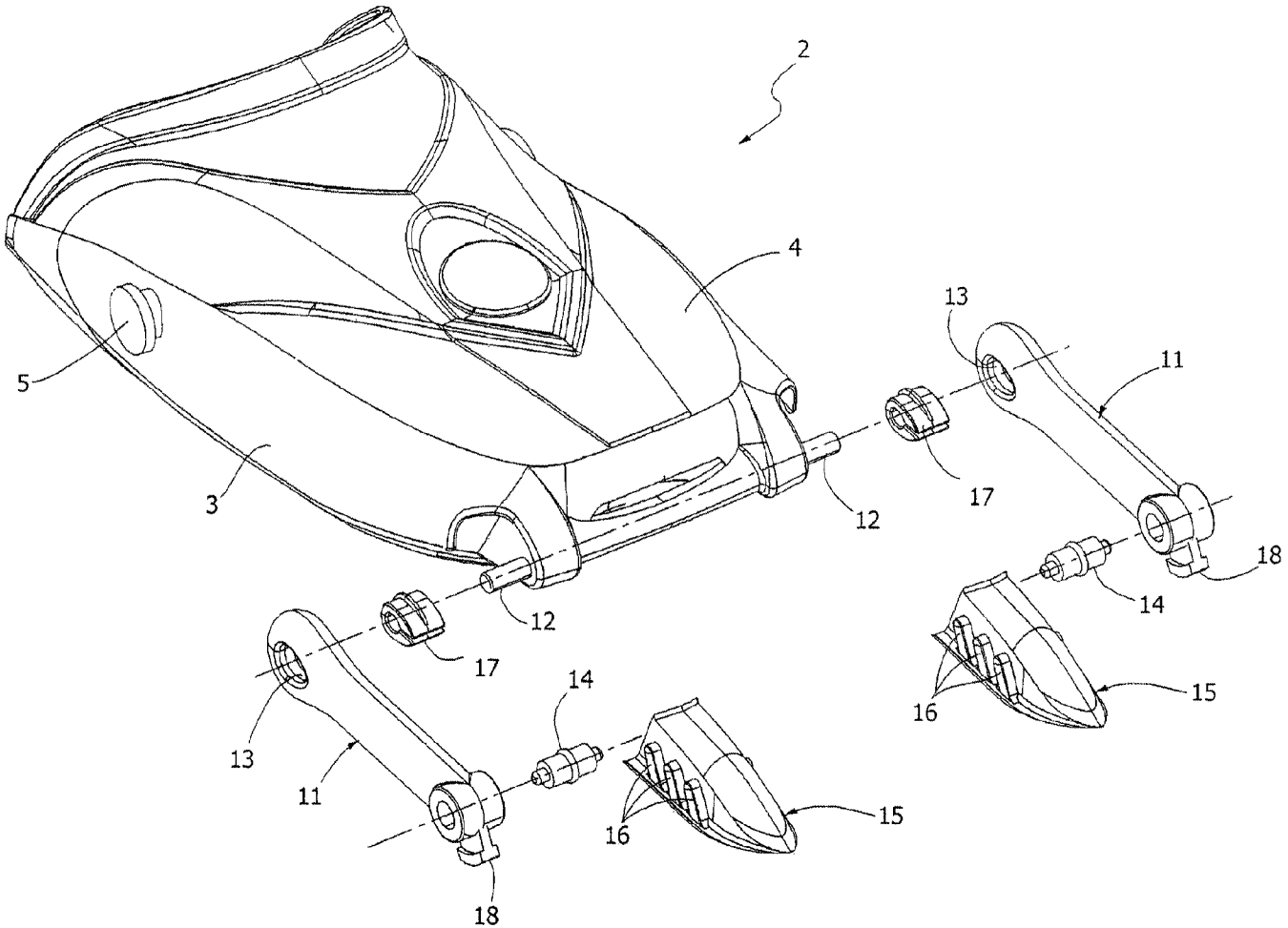
FIG. 12 is an exploded perspective view at a larger scale of a part of the flipper.
Figure 13:
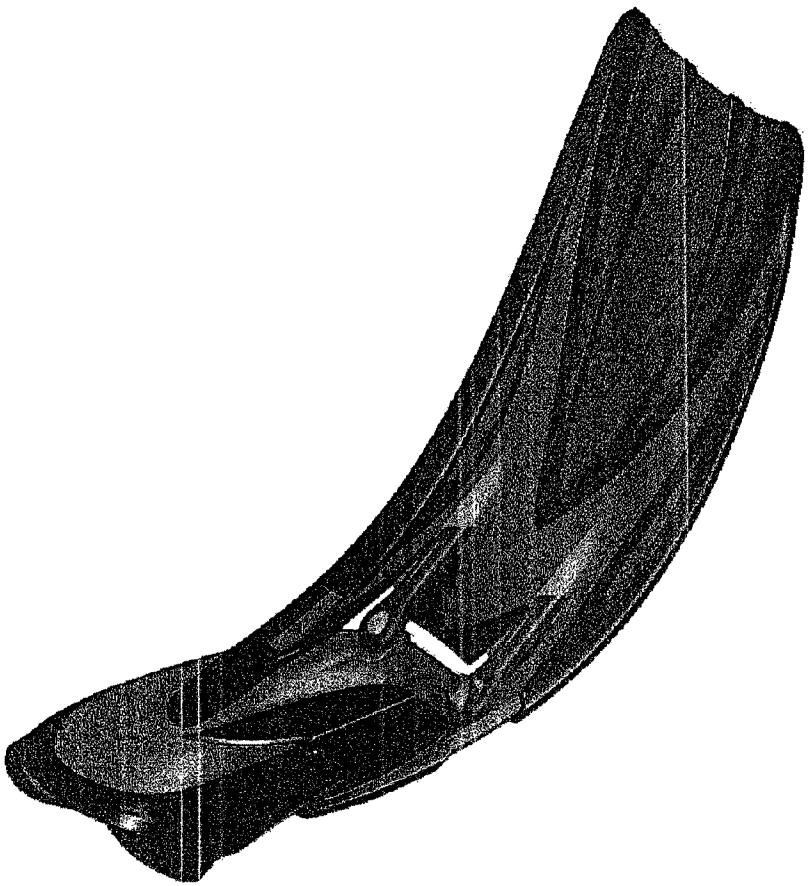
FIGS. 13 to 18 are perspective views, in various subsequent phases of kick-down, of the elasticas of the flipper viewed from above and from beneath.
Figure 14:
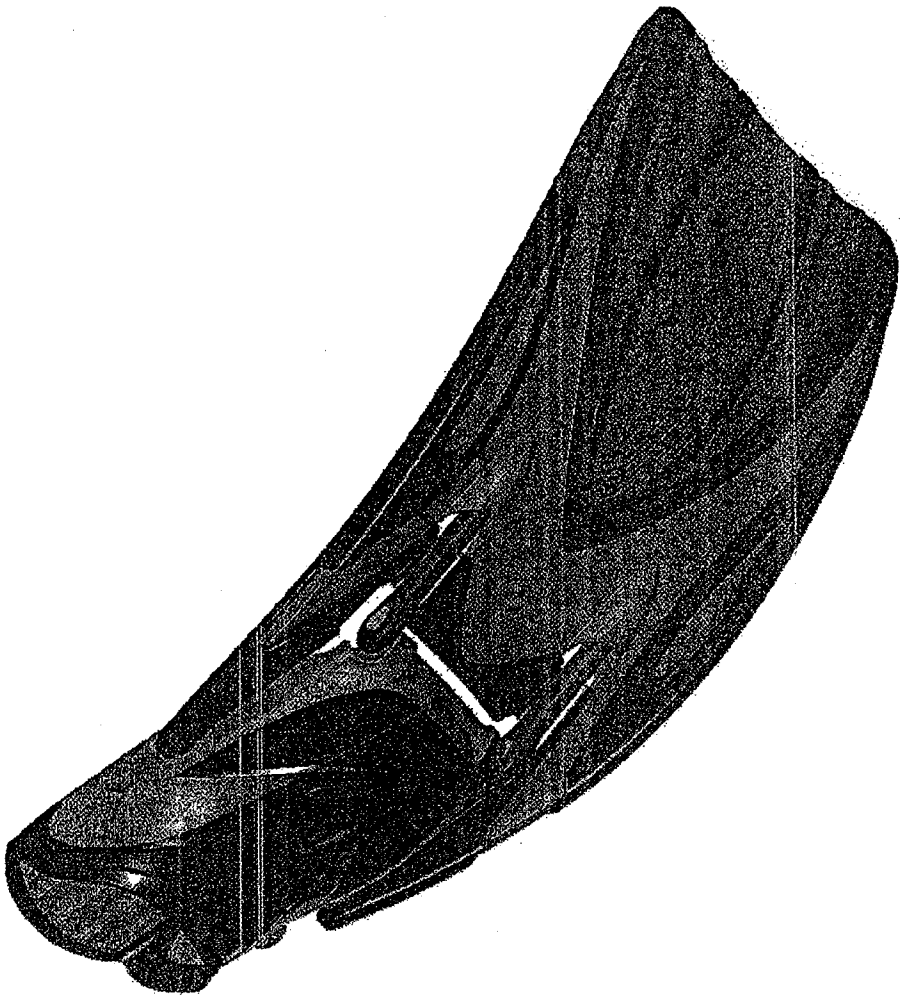
Figure 15:
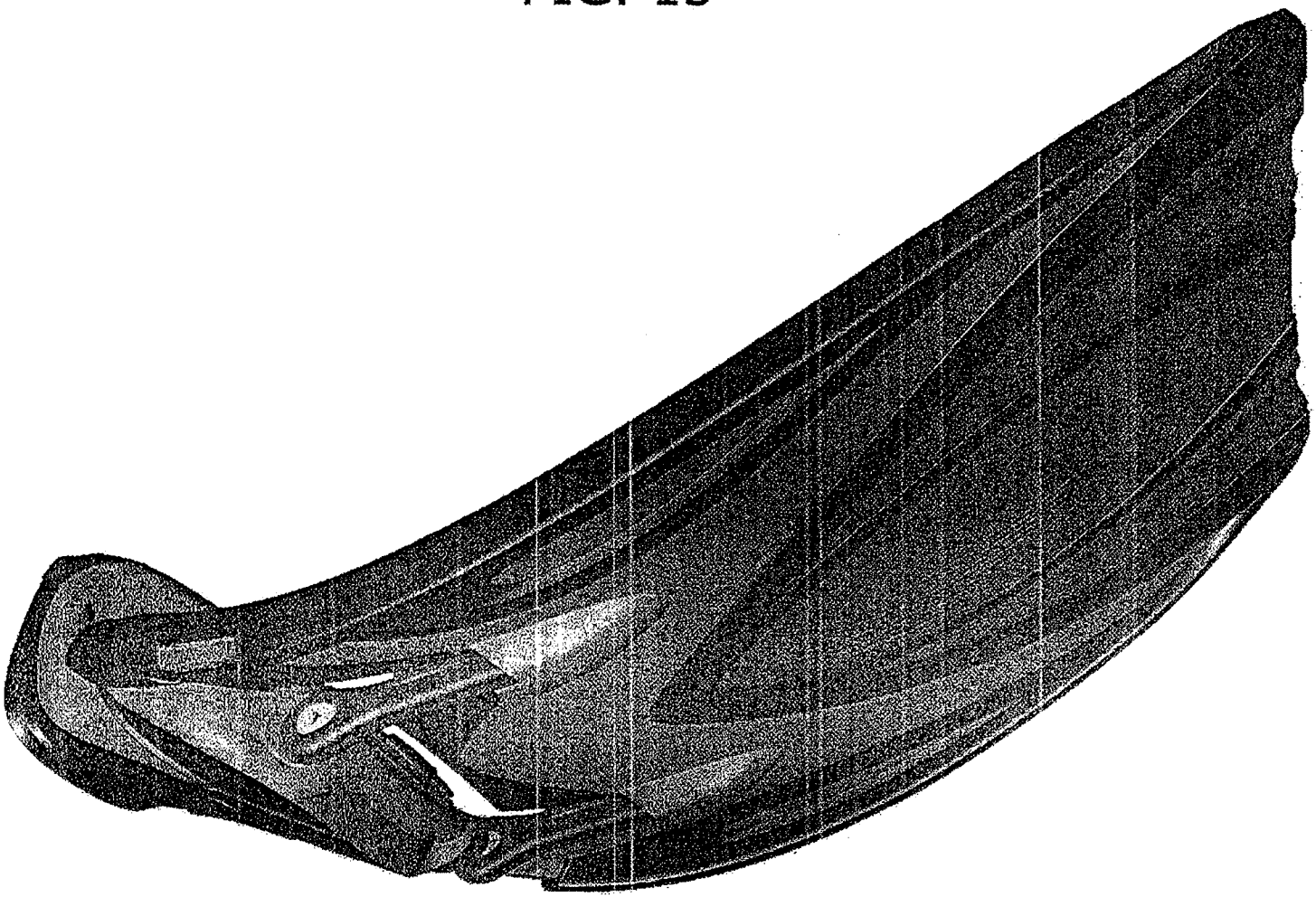
Figure 16:
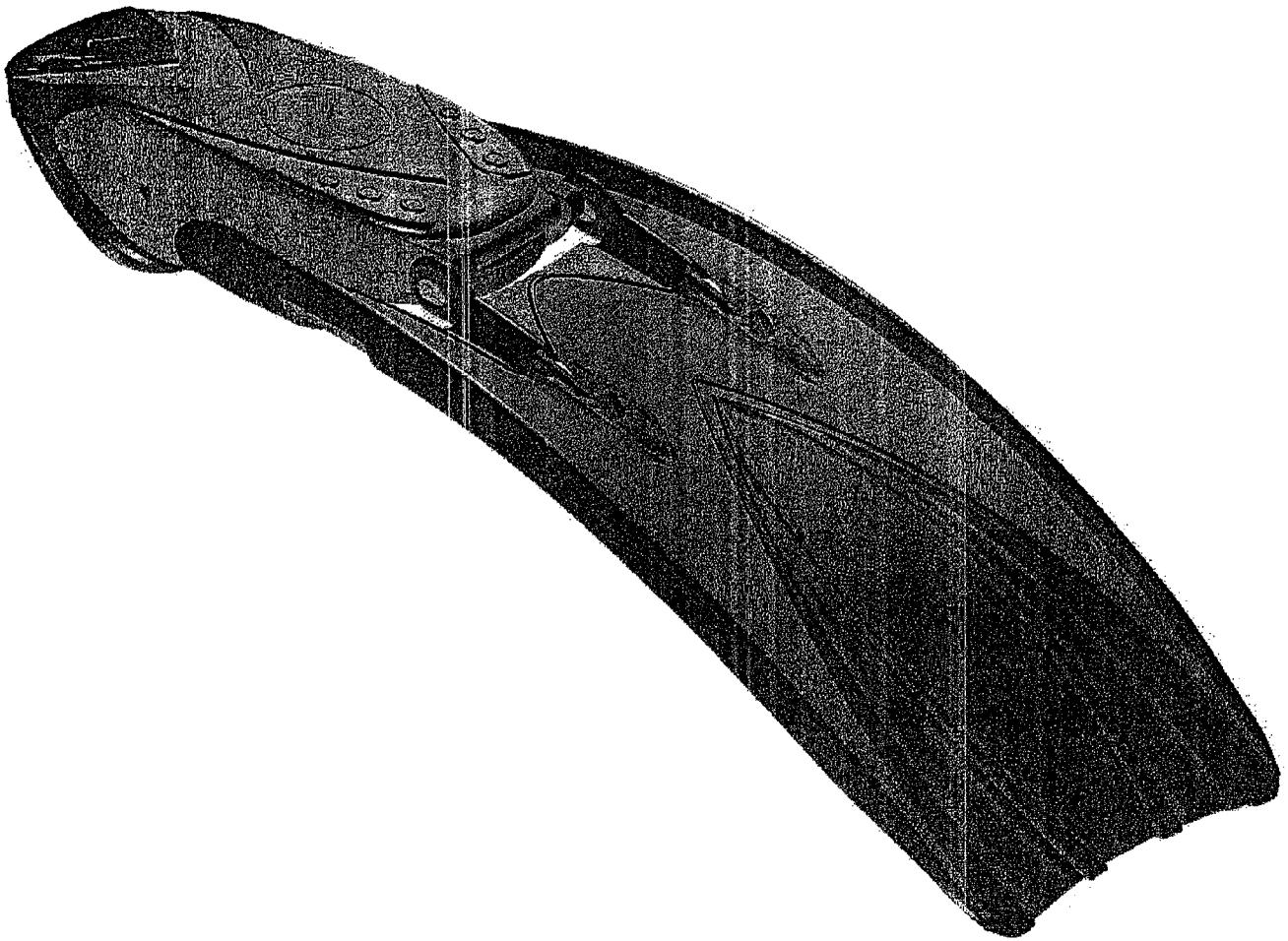
Figure 17:
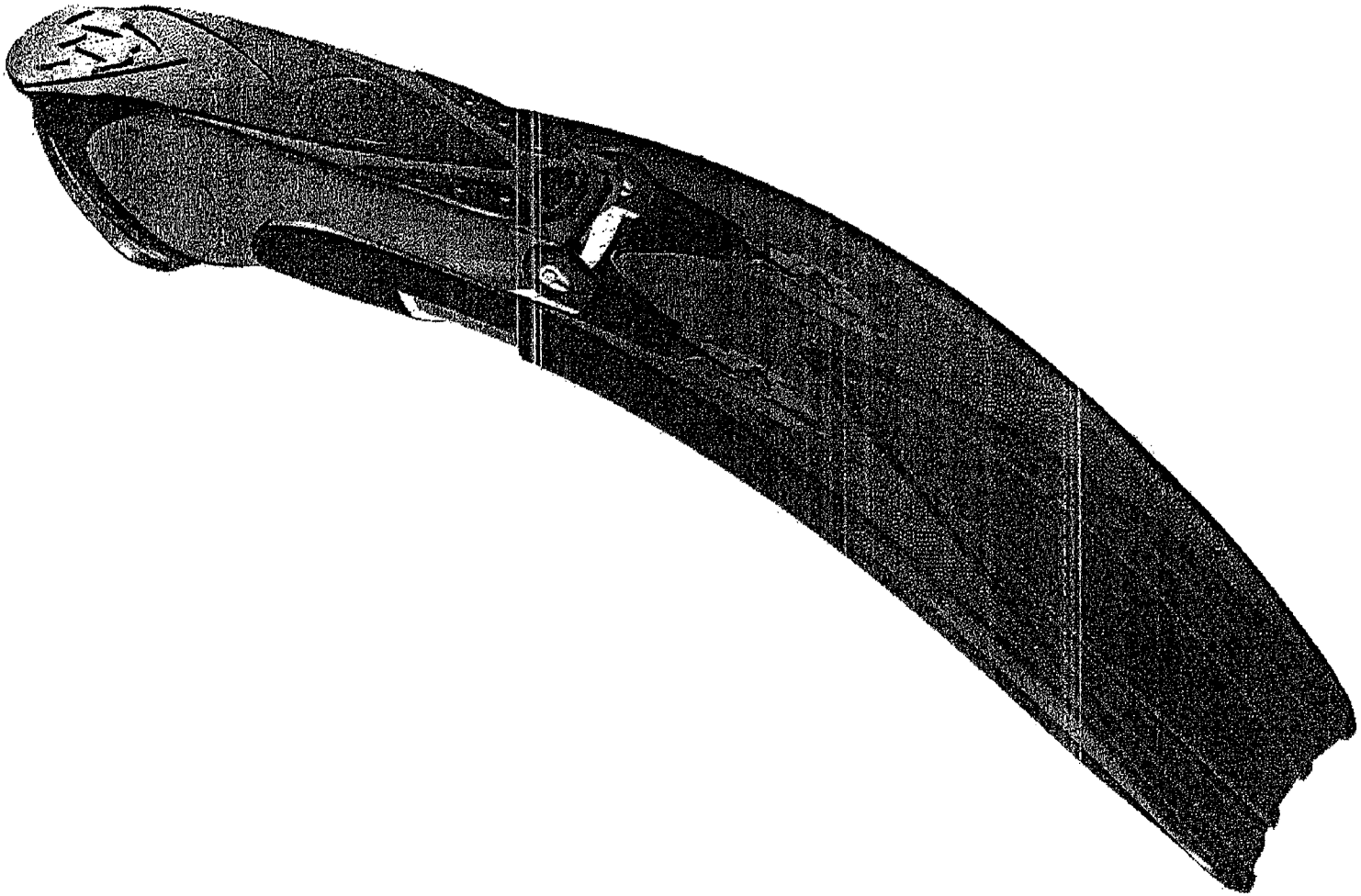
Figure 18:
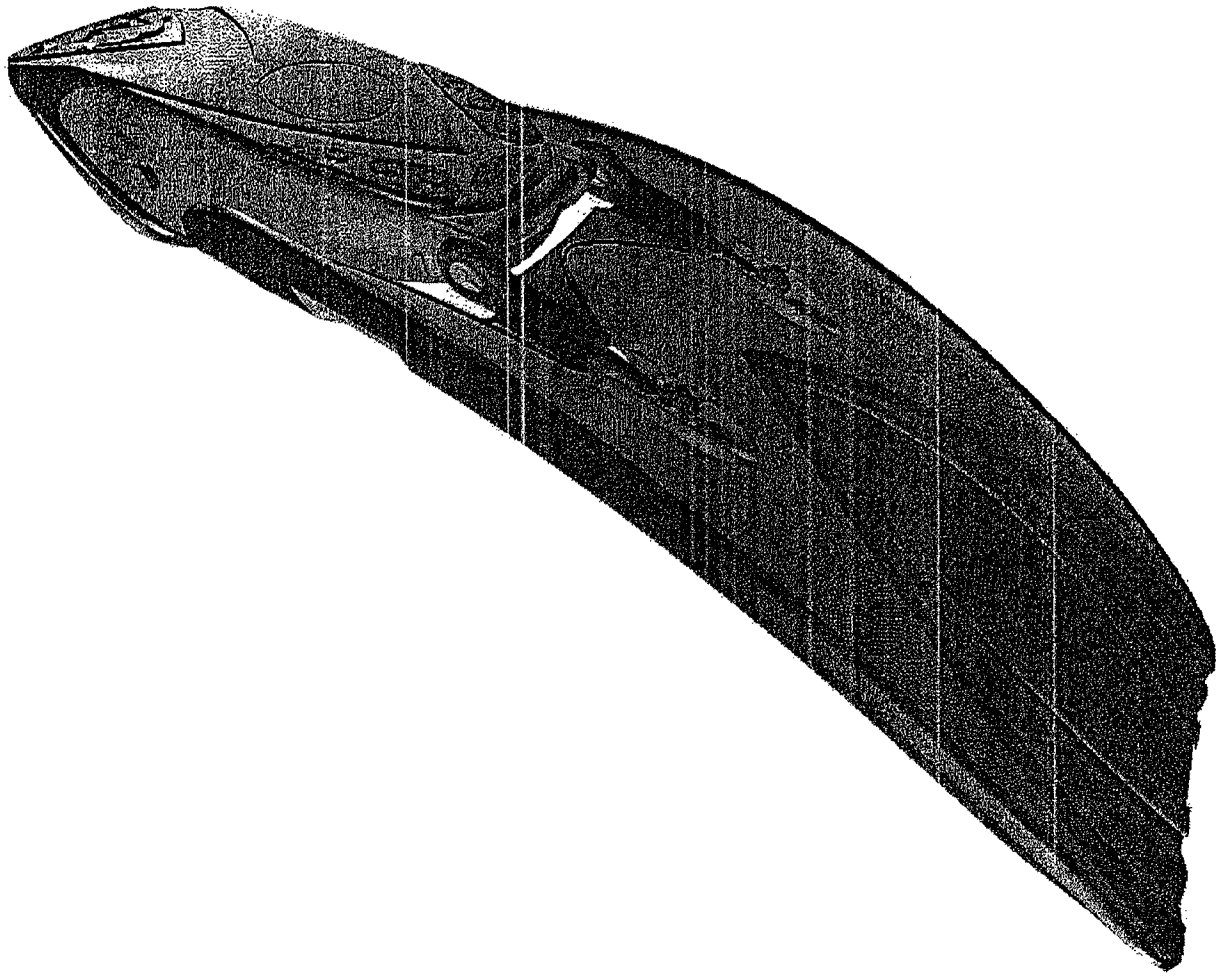

A fundamental aspect of the invention, perfectly identifiable in the example illustrated and highlighted with a dashed line in FIG. 9, is an opening or gap 10 i.e., a completely empty area without any material, which is located between the rear part of the blade 2 and its two rigid arms 8 projecting backwards, and the front part of the shoe 2, which includes also the front portion of the sides thereof. The function of said "non-connection" is to exclude, in a way limited to the area described, any dynamic and kinematic constraint between the shoe 2 and the blade 1 for the purpose of transmission of forces and displacements in a direction substantially perpendicular to the plane of the blade (i.e., in a vertical direction in the case of flippering in a horizontal plane), delegating the indispensable mechanical connection to just the fixed side ends 9, located, as has been said, at the centre of the foot. The opening 10 is consequently absolutely indispensable to ensure proper kinematics for the flipper, i.e., the correlation between the movement of the parts with respect to one another and the dynamics envisaged by the invention, i.e., the interaction of the forces and of the reactions for the purpose of obtaining the correct and effective flow of the motor power from the leg to the shoe 2, from the shoe 2 to the blade 1, and from the blade 1 to the mass of water that is pushed backwards, with consequent high propulsive efficiency.

The opening or gap 10 must in any case constitute a void of longitudinal extension reduced to the minimum possible, in order for the discontinuity of flow inevitably generated thereby not to impair the efficiency of the flipper.

Alternatively, and above all for aesthetic purposes, as well as for regularization of the flow bed for the water, the "empty area" could be hidden by means of a thin flexible membrane, made of rubber material like the shoe 2 or also just flexible like the blade 1, provided that it is markedly flexibilized by means of, for example, a wavy (concertina-like or bellows-like) structure, which will in any case enable an ample freedom of angular deflections between the front part of the shoe 2 and the rear part of the blade 1.

According to another fundamental aspect of the invention, the blade 1 is moreover connected to the front part of the shoe 2 by means of connection members constituted preferably by a pair of longitudinal elastic tie-rods 11.

A classic example of embodiment of said tie-rods can consist in a pair of robust cylindrical elastic elements, made of vulcanized, preferably silicone, rubber, hence not subject to ageing or to yielding; said rubber can be colourable in order to distinguish the different types and the different elastic moduli of the tie-rods to facilitate their interchangeability. The tie-rods 11 are arranged longitudinally in front of the front end of the shoe 2, which, as is illustrated in detail in FIG. 12, can for example be provided with two transverse pins 12, projecting laterally from the rigid fairing 3 of the shoe 2. On these two pins 12, the rear ends of the two elastic tie-rods 11, formed with robust eyelets 13, are engaged, possibly blocked with respective internal thimbles 17. The front ends of the tie-rods 11 house instead—but this is only one of the various possibility embodiments—a pair of transverse rollers 14 with two diameters, or else shaped pins, the ends of which come to engage in anchorage and adjustment members 15 fixed to the blade 1 and arranged in the direction of its central area. Said anchorage members 15 can, for example, be constituted by a pair of pocket-like seats, in which the rollers are engaged, or else by two multiple successions of pocket-like seats 16, arranged one after the other at a certain distance apart, like a rack, in such a way as to enable, by choosing one or another of homologous pairs of pocket-like seats 16, a careful pre-selection of the tensioning of the tie-rods.

This adjustment considerably affects the dynamic behaviour of the flipper and enables the user, according to his own physical condition (level of training, degree of tiredness, liability to cramp) and to how demanding the dive is (with heavy or light equipment, breath-holding free-diving, snorkeling, or scuba diving) and of the presence of sea current, to choose the most appropriate "gear ratio": powerful and reactive flipper, with maximum pre-tensioning; supple and restful flipper, with minimum pre-tensioning.

Thanks to minor arrangements (for example, a gripping appendage 18 formed on each tie-rod 11), the above operation will be possible with the user's bare hands, also underwater and, if need be, even with the flipper already on the user's foot. With the elastic tie-rods 11 released from the racks 16, it will also be more convenient for the user to walk out of the water (in the case of beach diving).

The two elastic tie-rods 11 along their extension between the respective anchorage points can be free, or else (as in the case of the example illustrated) can rest in a slidable way, on the dorsal face of the flipper, on respective bridges carried by, or formed integrally with, the blade 1.

Figure 5:
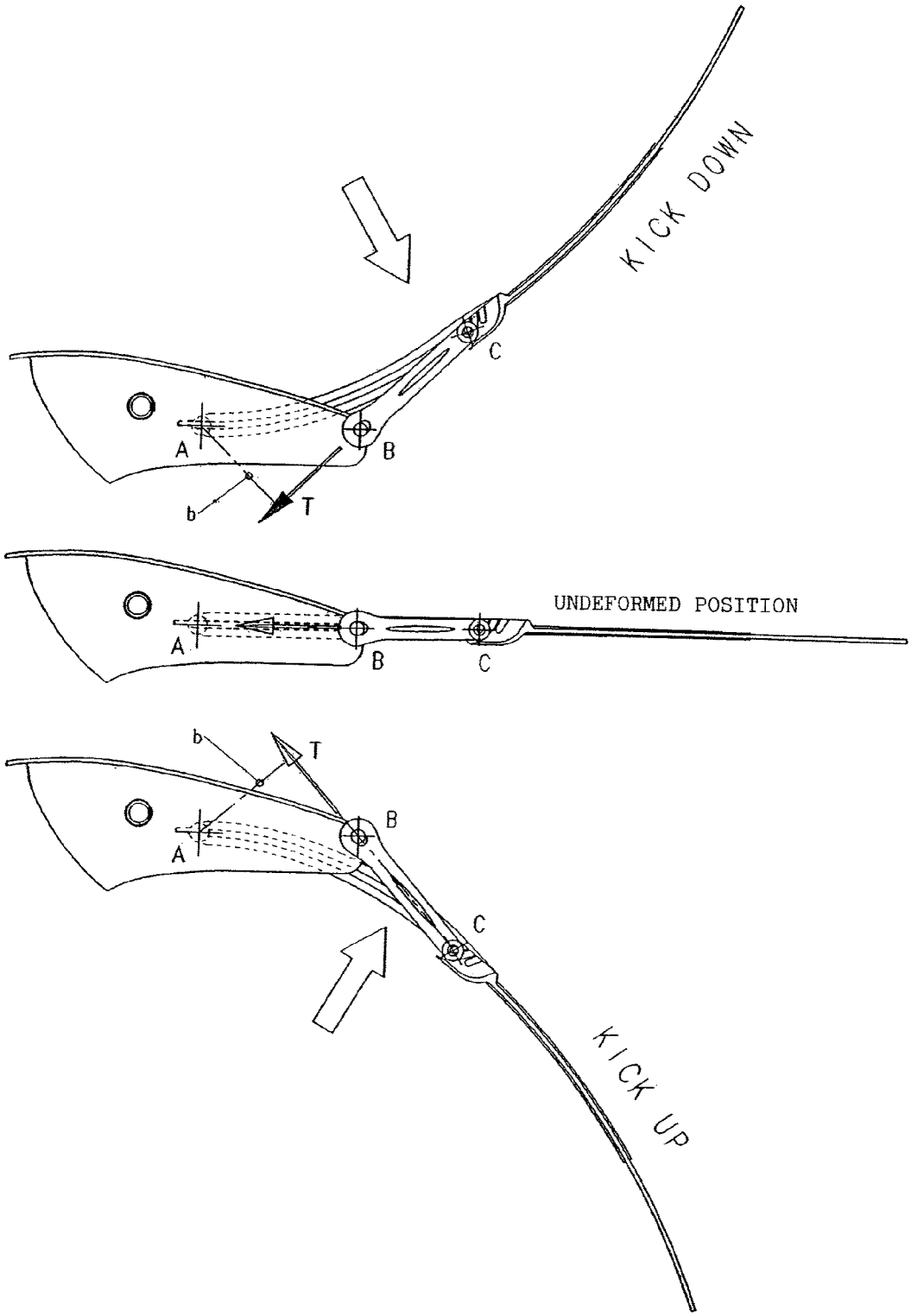
Figure 6:
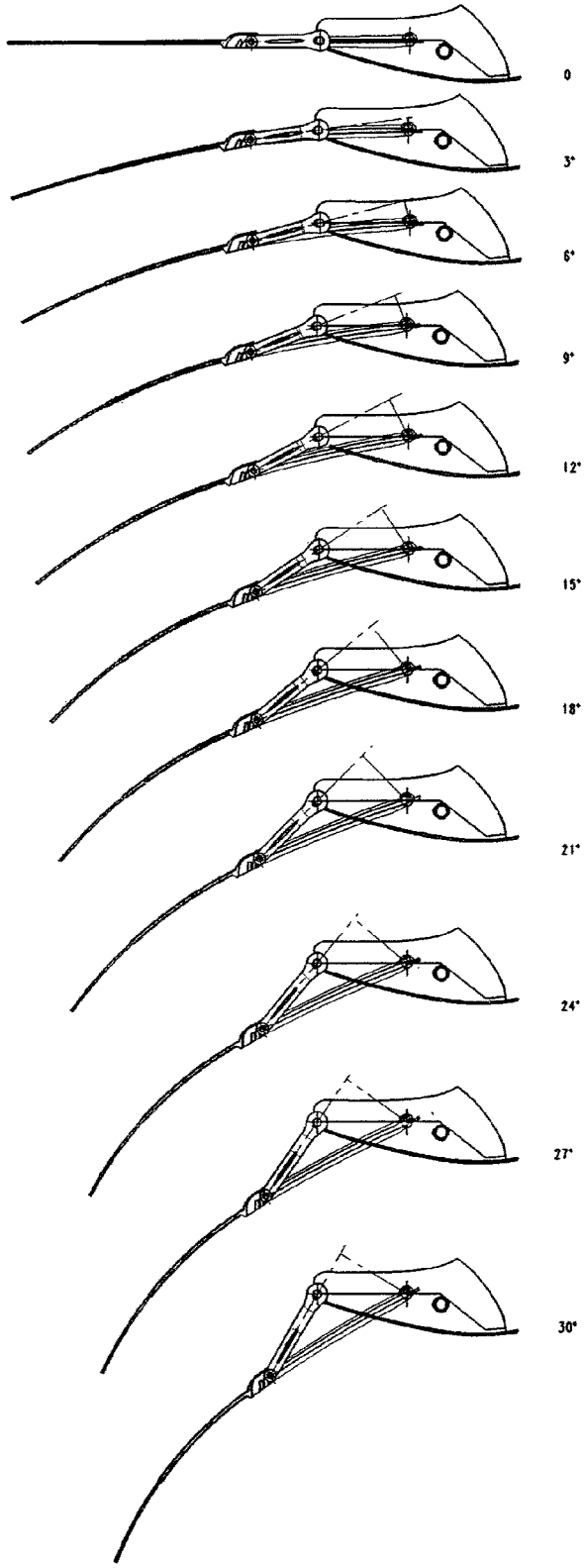
Figure 7:
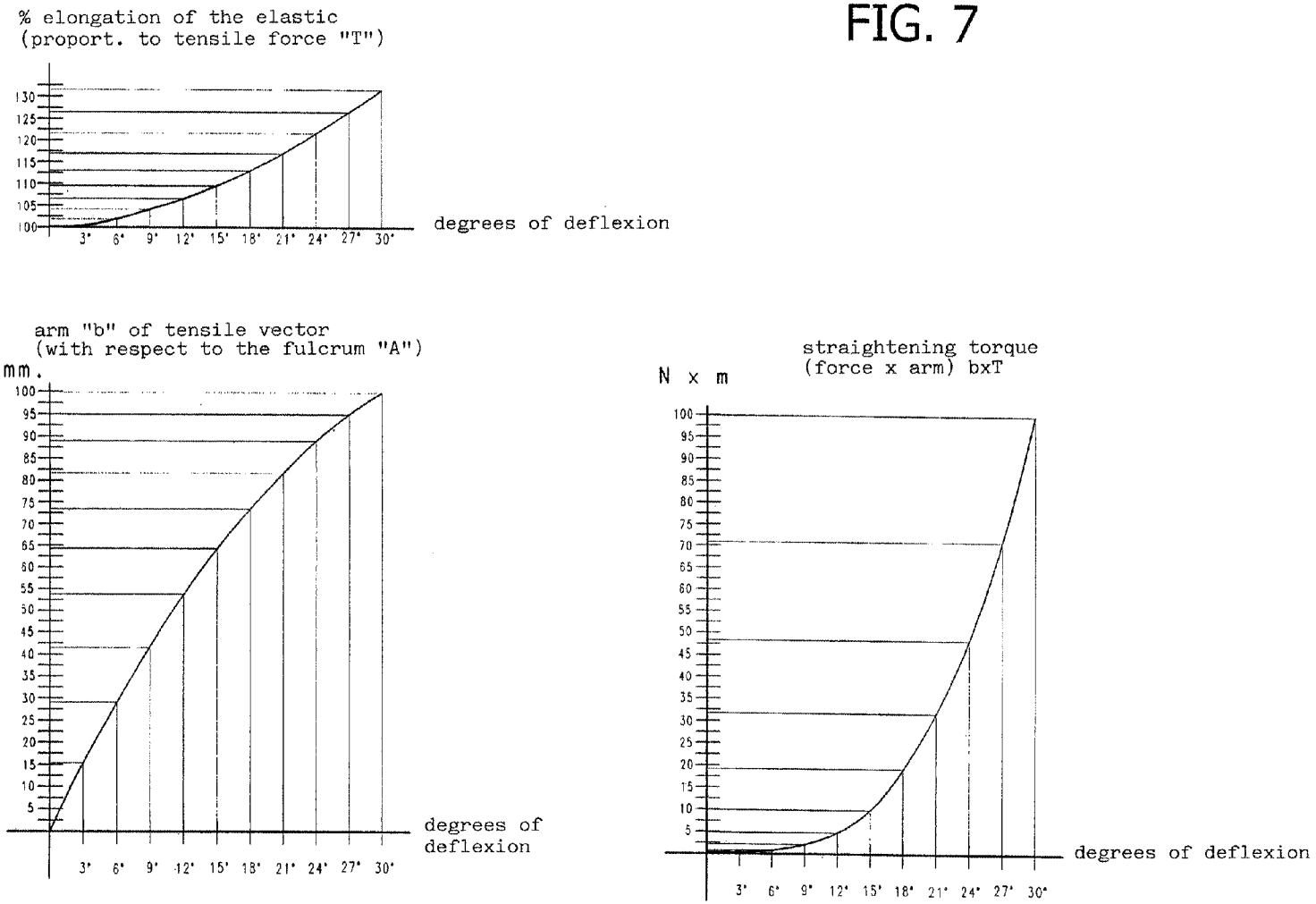
Figure 8:
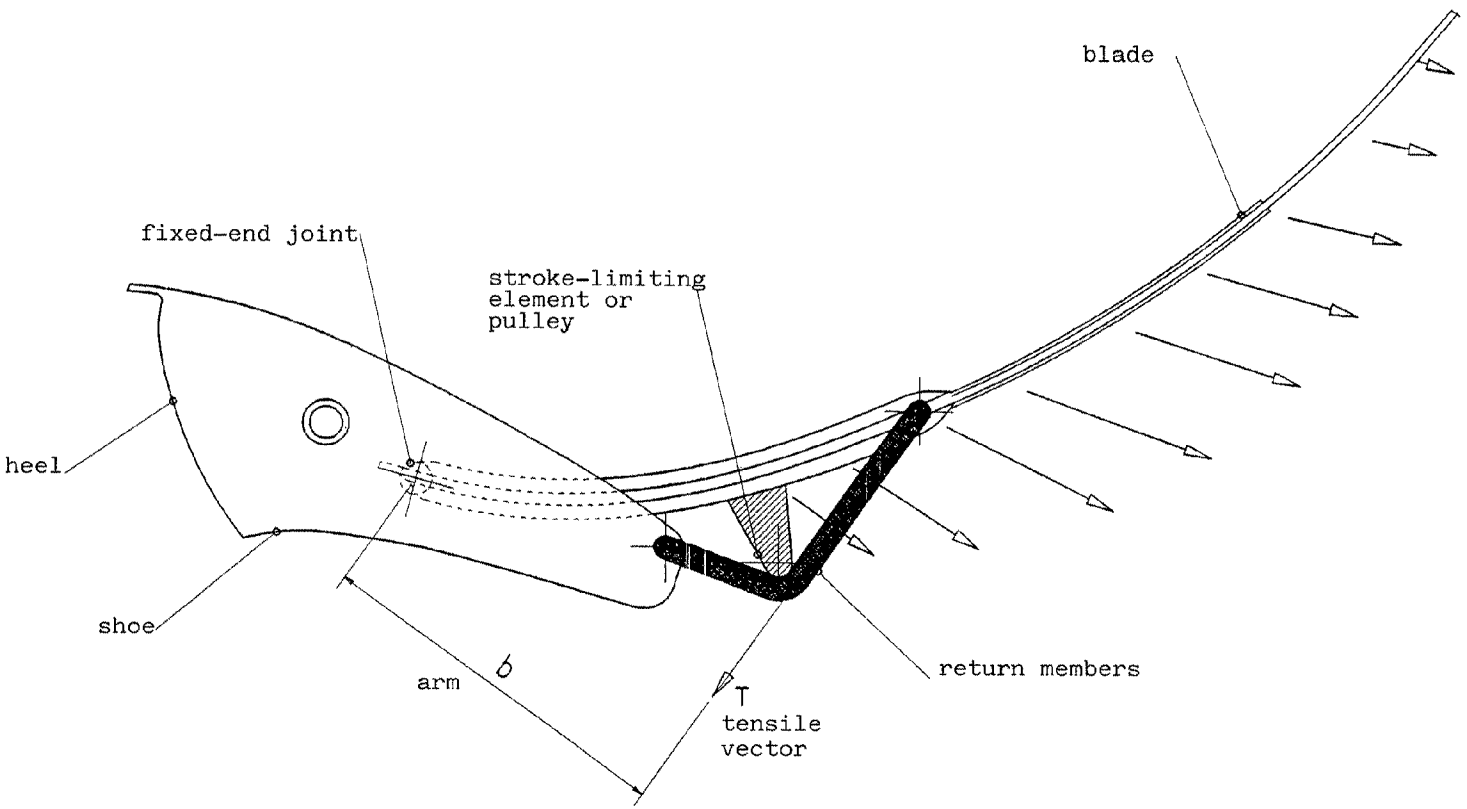

To return now to FIGS. 5 and 6, already described previously in general terms, the operation of the flipper according to the invention will now be explained in greater detail.

Thanks to the connection of the blade 1 only to the central area of the shoe 2, by means of the longitudinal side members 7 prolonged backwards with the respective arms 8 fixedly jointed to the rigid structure 3 of the shoe 2, the bending kinematics of the system is extremely advantageous.

As soon as the leg starts its movement, for example that of the downward stroke (kick-down)—considering the swimmer always in a prone position—the shoe 2 goes down but the blade 1 is unable to counter the water forcefully.

Practically, this initial phase is a kick against the water, which is still unable to oppose resistance: the tensile force of the elastic tie-rods 11 is equal to just their pre-loading, and their straightening effect is zero because the extremely small tensile force exerted thereby has zero moment with respect to the fulcrum of rotation represented by the fixed-end joint 9 at the centre of the foot. The leg and the ankle do not feel any resistance, accelerate, and store kinetic energy.

It is only when the blade 1 has reached a considerable deflection that the vector that represents the tensile force of the elastic tie-rods 11 starts to increase in intensity and to acquire a significant arm with respect to the fixed-end joint 9 at the centre of the foot. The human motor—the leg—and the transmission joint—the ankle—feel the growing resistance, but are by now kinetically launched, and the inertia manages to absorb the stress. The flippering action is thus round and powerful, without initial jerks at the reversal of the kick. Above all, the movement of translation of the swimmer in the water occurs without sudden accelerations and decelerations, and hence with the maximum energy saving.

At the start of kick-down, the foot drops rapidly downwards (supposing the swimmer to be in the horizontal condition), but the blade does not follow it: the mass of water corresponding to the blade remains practically immobile and does not absorb power. The area useful for flippering extends throughout the length of the blade, and the angle of impact of each elementary surface "cmq" of the blade with respect to the water is markedly propulsive. Hence, the propulsion/effort efficiency is extremely high.

During the two phases of propulsion proper, i.e., of kick-down and kick-up (exemplified progressively in FIG. 6), the deflection of the blade 1 and its elastica can in this way reach an optimal value, in such a way that the range of the angles reached in each point by all its elementary surfaces "cmq" is the most advantageous for guaranteeing a convenient ratio between energy acquired (in the numerator) and energy applied (in the denominator). This is obtained in a way altogether comparable to the correct adjustment of a sail for a given rate of sailing, or else to the correct design of a turbine blading.

The above accurate instantaneous adjustment of the deflection is markedly facilitated by three requisites, all three purposely incorporated in the flipper forming the subject of the example of embodiment: first, the particular geometry with three fulcra described previously, which leads to a rapid raising of the tensile stress in the elastic tie-rods 11 as the angle of deflection increases; second, the rapid increase of the arm of lever of the "tensile" vector with respect to the fixed-end fulcrum 9 at the centre of the foot; and third, the altogether non-Hookean behaviour of the elastomer chosen for the tie-rods 11, which arrives in the proximity of the maximum elongation according to an altogether normal law of proportionality to the first or second power of the variable "elongation", but at the end shows a sharp rise, proving practically inextensible. This is the situation of an extremely vigorous flippering, where the elastomeric tie-rods 11 are used as if they were inextensible, thus guaranteeing an immediate and extremely powerful elastic return.

The graphic representations of FIGS. 13 to 18 highlight, in various successive phases of kick-down, the elasticas of the flipper viewed from above and from beneath. There may be noted: the various degrees of angular deflection between the plane of the first part of the blade 1 and the median plane of the shoe 2; the elongations between the front margin of the blade 1 and the front margin of the shoe 2; and the tensioning of the elastic tie-rods 11, which differs case by case in terms of intensity, direction, and arm with respect to the fulcrum.

DESCRIPTION OF VARIANTS OF THE INVENTION

A variant of the invention may be conceived for aesthetic purposes or else to guarantee particular effects of homogeneity of the flow of water. Since the empty area 10 located between the front part of the shoe 2 and the rear part of the blade 1 could constitute a discontinuity that is not only mechanical (which is considered essential for the invention) but also aesthetic and fluid-dynamic, as already anticipated it is possible to hypothesise "hiding it" or covering it with a "fairing" using a thin membrane of elastomeric material, or even flexible material having a wavy or bellows-like shape in order to enable the indispensable angular deflections between the plane of the blade 1 (rear area) and that of the shoe 2, without reducing the degrees of freedom of the system to a determining extent.

A further variant may stem from the considerations, mentioned previously, regarding the appropriateness of enabling asymmetry in the kinematics of kick-up and kick-down in order to take into account both the different anatomical structure of the joints of the swimmer's body and the different power of the muscular fasciae concerned. It is possible in fact to envisage the connection between the shoe 2 and the blade 1 in such a way that the possibility of angular deflection between the blade 1 and the shoe 2 described above is possible only in one of the two kicks. By way of example, it is possible to envisage that the connection between the shoe 2 and the blade 1 is made no longer by means of the two retro-protruding side arms 8 described previously, but rather by means of a prolongation backwards of the rear part of the blade 1. This variant is exemplified in the two alternative solutions illustrated schematically in FIGS. 19 and 20.

Figure 19:
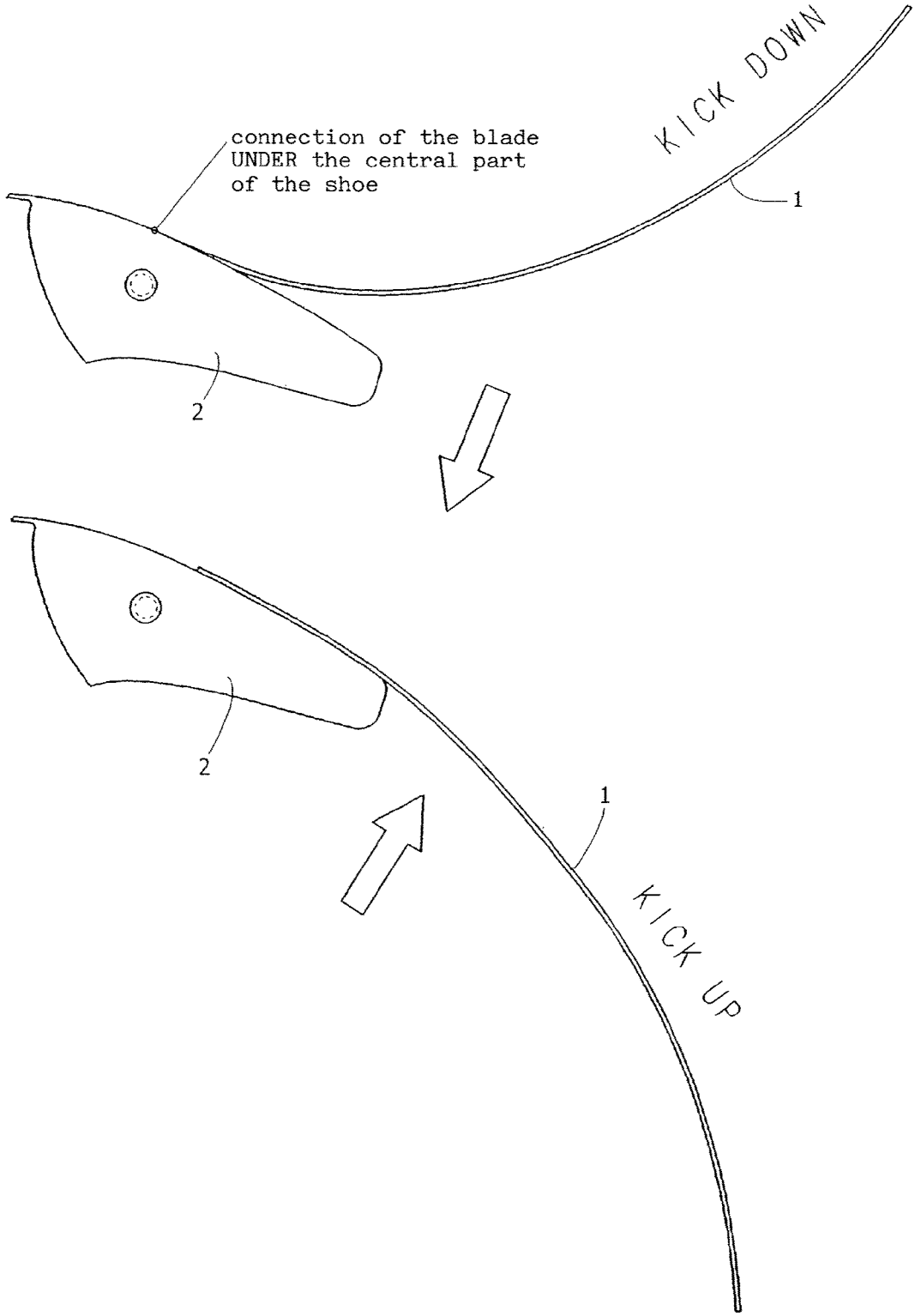
FIGS. 19 and 20 are schematic views in side elevation of two possible variants of the invention in the phases of kick-down and kick-up.

In the case of FIG. 19, the blade 1 proceeds under the tip of the shoe 2 without connecting thereto up to the centre of the foot (or else even further back, towards the heel), where the connection is made. Clearly, in this case, only the deflections corresponding to kick-down are allowed in so far as, in kick-up, the blade 1 rests on the sole of the shoe 2 and the flipper behaves like a normal flipper. This variant could be advantageous for swimmers who are beginners, who during kick-up tend to nullify the effort exerted by bending their ankle.

Figure 20:
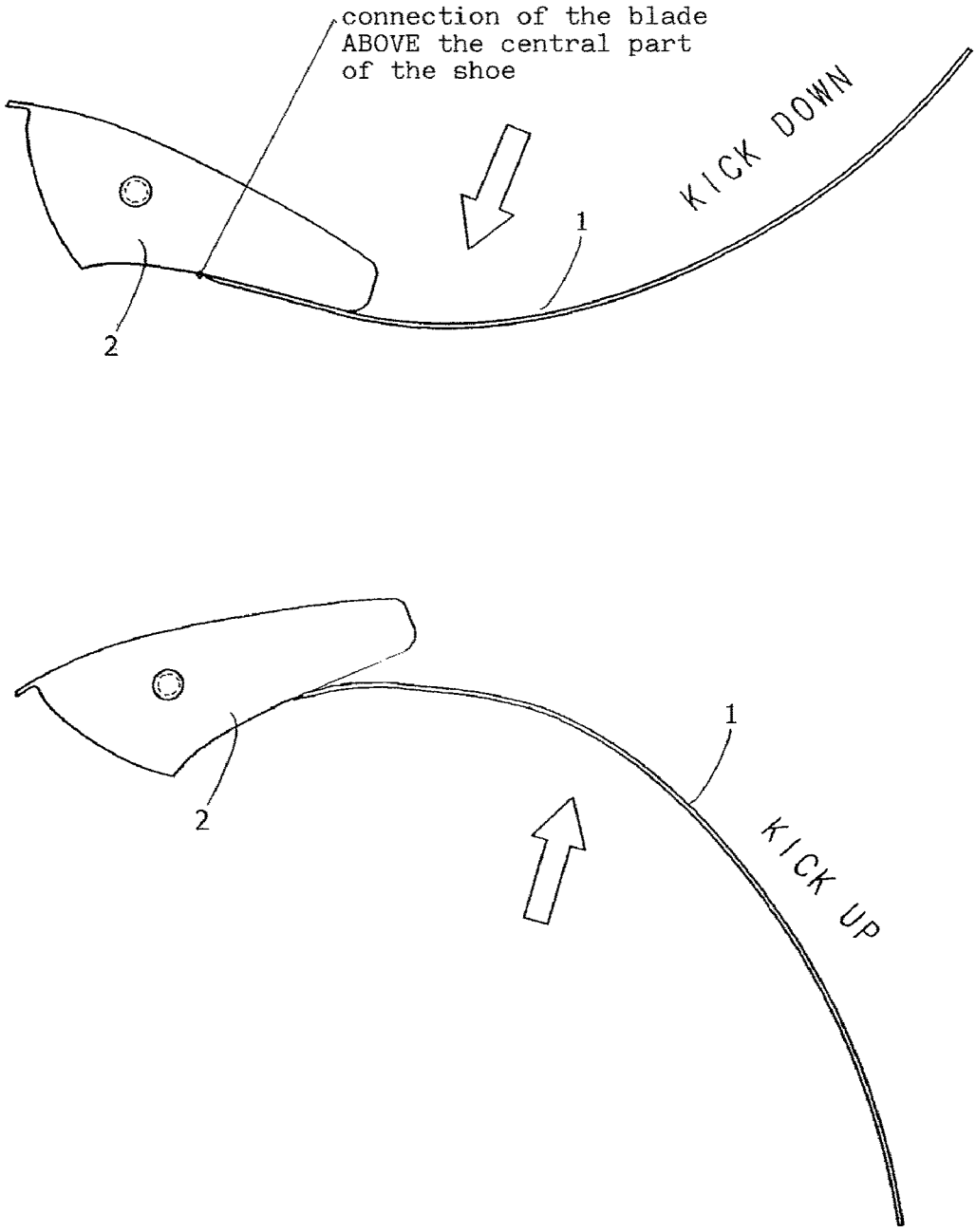

In the case of FIG. 20, the blade 1 proceeds above the shoe 2, is not connected to its tip or front part, and is connected to the shoe itself at the centre of the instep or further back still. In this case, only the deflections corresponding to kick-up are possible.

According to further variants (not illustrated), the return members 11, instead of being made separately from the blade and the shoe and then subsequently assembled (as has been said) in a possibly removable way to the flippers already produced, can be englobed therein by means of co-moulding. Furthermore, the tie-rods 11 could be not longitudinal but oblique or transverse, and in any number, provided that they are such as to exert an action of return between the tip of the foot and the blade, and could even be constituted by springs made of metal or plastic material, designed in any case to transmit tensile forces between the respective rear couplings and the front fulcra. Instead of two return members, it is also possible to envisage just a single central one, or else a number higher than two, or else single tie-rods but having a design that is more complex in plan view, for example annular, U-shaped, triangular (with two points of connection to the blade and one to the shoe or vice versa), polygonal or, however designed, provided that they are able to transmit the flow of energy from the swimmer's leg to the blade according to the three-fulcra kinematic and dynamic scheme illustrated which constitutes the primary subject of the invention.

The return members 11 could also be non-elastic but have a pre-set length and be mounted so as to enable an initial idle travel and instantaneously reaching their end-of-travel when the blade reaches the maximum deflection allowed. These may also be integrated with additional arrangements, such as, for example, cushioning elements designed to damp any jerks that might be too severe.

According to a further variant (not illustrated), the return members 11 could be englobed in, or constituted by, the retro-protruding side arms 8 of the blade 1 themselves.

Figure 21:
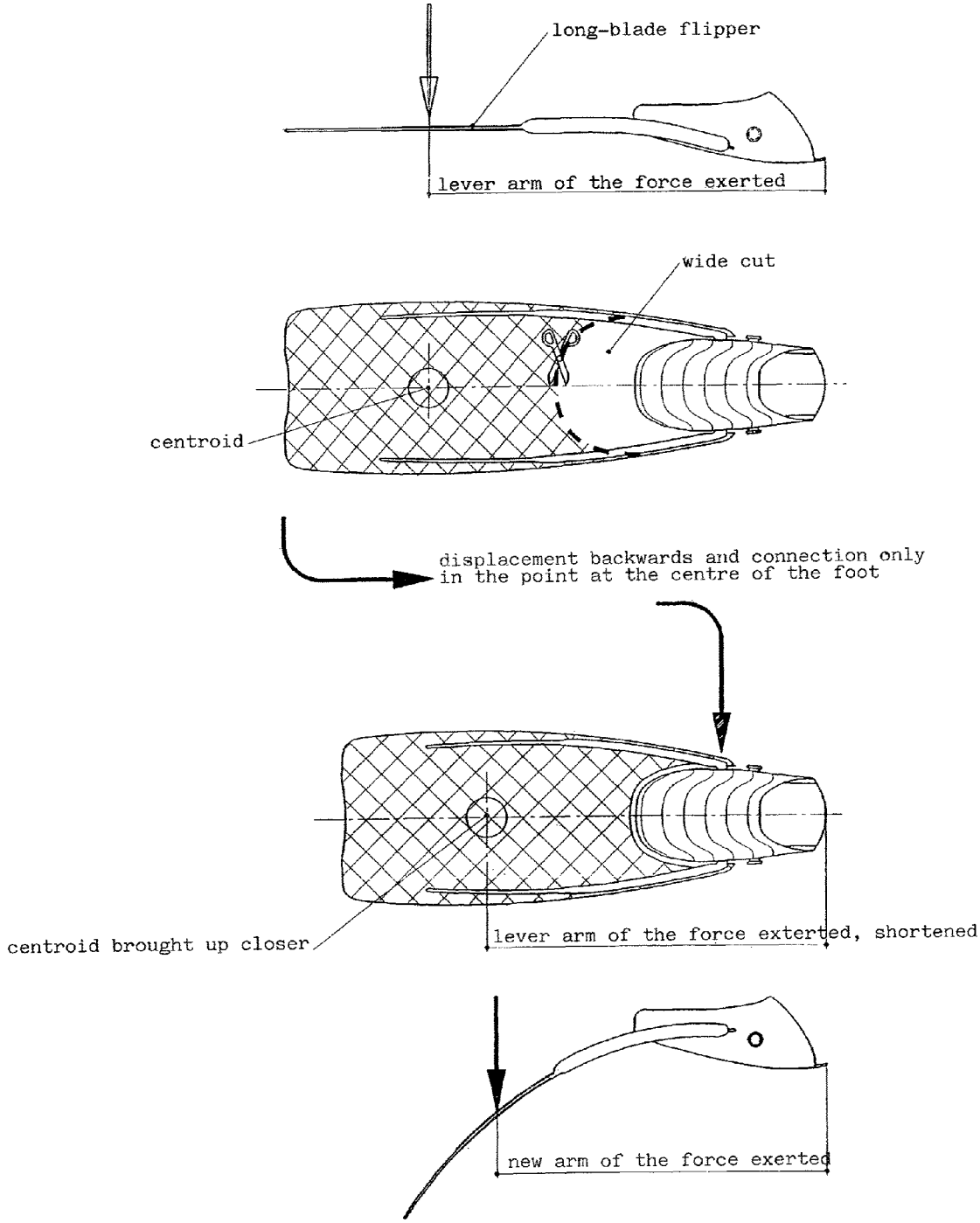
FIG. 21 is a diagram that exemplifies a way of describing the genesis of the idea underlying the invention.

To sum up the inventive idea underlying the present invention, with reference to the diagrams of FIG. 21 it may be stated that is common knowledge that the most effective flippers, amongst the ones built according to the known art, are flippers with a long blade, universally used for swimming competitions and breath-holding deep diving. Their superior effectiveness consists not only in the greater extension of the surface, but also in the fact that the deleterious braking effect of the first third part of the blade is abundantly counterbalanced by the propulsive efficiency of the second third part and the last third part, towards the end of the flipper. They are obviously more tiring because the vector of the "resultant of the forces of kinetic thrust of the water on the blade" is located very far from the fulcrum of anatomical rotation (the hip joint) and consequently has a considerable arm of lever with respect to said axis.

To reduce the effort drastically, the inventor has considered (and this represents an alternative way of describing the genesis of the idea underlying the invention): a) eliminating the braking portion of the blade by making a cut that removes the entire core of the first third of the blade; b) displacing backwards the entire residual part of the blade, without restoring the connection with the tip of the foot but connecting the rear end of the two residual longitudinal side members with the central area of the shoe; and c) inserting the powerful elastic-return members.

In practice, the present invention enables the advantageous effects described previously to be achieved basically thanks to a flipper for underwater activities, swimming, or muscular training, constituted basically by a shoe and a blade, in addition to possible accessory parts; in said flipper, for reasons of brevity, the following three main areas are defined as a), b) and c):

a) central area of the shoe;

b) front area of the shoe; and c) rear area of the blade (facing the area b)), in which:

the areas b) and c) are kinematically and dynamically disconnected, thanks to the presence between them of a wide gap substantially shaped like a horseshoe, which surrounds the entire tip of the foot. The shoe and the blade are consequently not connected until the fixed-end section is reached, which is located in the area a) and is possibly shifted further back, so that as the foot moves the area c) is not forced to follow the area b) dynamically, but can instead remain behind it (vertical distancing) because it is withheld by the inertia of the mass of water that is still immobile. With the flippering action, the blade thus assumes a considerable angle with respect to the shoe (angular arrangement), deflecting in such a way as to impact the water not at 90° but with wider and optimal angles both for the purposes of propulsion and in terms of an appreciable reduction of effort on the part of the swimmer;

set between the areas b) and c) is a system that both limits the vertical distancing thereof, and to charging and discharging itself rhythmically with elastic energy, performing also the function of energy accumulator.

The elastic system can be made simultaneously to moulding of the flipper, and can be connected to the flipper in a permanent way, for example by means of co-moulding on previously formed parts, or else can more conveniently be assembled on the flipper in a removable way at one or both of the ends thereof.

The elastic system makes available an effect adjustment (for example, obtainable by varying the degree of pre-tensioning, or the direction, or else by replacing the elastic member with another having different elastic characteristics) so as to affect, according to the choice of the user, the mode of transmission of power from the leg to the blade and from the blade to the water.

In brief, the invention envisages the characteristics listed below either individually, alternatively, or in combination with one another:

the flipper includes a blade and a shoe, in which the blade constitutes the member for propulsion and the shoe defines the housing for the user's foot, in which the median plane of the blade corresponds, as regards its position in space, to the natural prosecution forwards of the plane of the sole of the shoe or of the instep thereof or of planes intermediate between the two aforesaid planes, in which the blade has a rear margin adjacent to the shoe, and the shoe has a front margin facing the blade, said margins, when the flipper is in the undeformed condition, being close to one another, in which the shoe can be considered divided into a front third part, a central third part, and a rear third part facing the heel, in which the connection between the blade and the shoe, instead of occurring directly between the front end of the shoe and the rear end of the blade, thus creating a continuous structure possibly stiffened by appropriate longitudinal thickenings or ribbings, is obtained, instead, by means of the fitting of two retro-protruding side arms coming from the blade to the rear part thereof and structurally connected thereto, with an area of the shoe corresponding substantially to the central third part of the foot, leaving an ample region of the front periphery of the foot and of its right and left lateral areas altogether disconnected from the blade, for a length comparable to the first third of the shoe, and in which said non-connection is obtained by means of a relatively narrow area without material, such as a gap, which flanks the entire front part of the foot and its two sides for the entire first third, thus obtaining the effect that during the action of swimming the rear margin of the blade is not constrained to the front margin of the shoe, so that the translations upwards and downwards of the shoe do not force the blade to follow it in a rigid or immediate way, moreover enabling during the various phases of the action of swimming an ample possibility of variation in the angular deflection between the plane tangential to the sole of the shoe and the plane tangential to the blade at its rear end;

return members are provided between the blade and the front area of the shoe and are connected to them, respectively, by means of their own front and rear ends, in a position appropriately calculated to obtain particular kinematic effects and consequently an advantageous dynamic behaviour, said return members being of a rigid/flexible or preferably elastic type and being such as to counteract the angular deflections between the shoe and the blade to limit the maximum range thereof, to oppose a resistance modulated according to the variable value of deflection;

the return members are constituted by an elastic structure (i.e., they are made of elastic material) with a high index of elastic return, suitable for accumulating considerable amounts of elastic energy and of returning it to the system completely or in any case with high efficiency; these can consequently be referred to as "energy storage elements";

the return members are not made of the same material as the blade or the shoe or formed simultaneously with the steps of injection moulding of one or the other, but are instead produced separately, with appropriate technologies and materials selected for guaranteeing better elastic characteristics, and only subsequently assembled, in a possibly removable way, on the flippers already produced, or else englobed therein by means of co-moulding;

the shoe, of the type with open heel and rear adjustment strap possibly provided with fast-release buckles, or else with closed heel, comprises soft areas for binding the foot, areas with high friction like the anti-slip sole, and a rigid structure with the function of transferring the flow of power from the leg to the blade of the flipper;

the blade, which has the function of propulsion member, has a generally plane shape, possibly reinforced with longitudinal ribbings, and possibly has: areas differentiated as regards thickness or type of material—for example, areas made of elastomeric material or else material with higher flexibility, such as membranes, bellows, flexibilizing notches, etc.; and areas that are appropriately shaped to obtain effects of channeling of the fluid threads, of scooping masses of water, of appropriate adaptation of the variable geometries induced by the kinetic pressure of the water during the action of swimming;

the aforesaid retro-protruding side arms of the blade are formed like lateral projections facing backwards and rigidly connected to the blade itself, possibly shaped to extend the longitudinal ribbings of the blade backwards and in any case in order to extend the rigid/flexible structure of the blade itself backwards, as well as in any case flanking the area corresponding to the front third part of the shoe for several centimeters;

the rear margin of the blade is without points for connection to the front part of the shoe, where by "front part" is meant not only the side facing the tip, but also the two sides on the left and on the right of the front part of the foot, for a length comparable approximately to the "first third" of length of the foot;

said two retro-protruding side arms are connected with fixed-end joints to the central or rear part of the shoe, preferentially to its rigid structure, by means of a type of fixed-end joint of sufficient strength as to transmit the flow of power that the leg sends to the blade; in the design of said type of joint, attention must be aimed at preventing collapse of the structure, ageing due to fatigue, the formation of cracks, etc.;

said two retro-protruding side arms are connected to the central or rear area of the shoe by means of a connection with rotatable constraint, for example a fulcrum of rotation;

between the rear part of the blade, including the two retro-protruding side arms, and the front part of the shoe, as well as the two lateral areas of the first third of the shoe, there is a cut made, shaped like a through slit without any material, in such a way that the connection between the blade and the shoe is provided exclusively or predominantly by the two retro-protruding side arms that proceed the lateral structure of the blade itself alongside the area between the tip of the foot and the first third of the shoe; said arms fitting in the central area of the shoe by means of a fixed-end connection or, alternatively, a pivoting connection, thus obtaining the effect that the rear margin of the blade is not forced to follow the tip of the shoe rigidly in its translations upwards and downwards, there consequently being possible a wide range of vertical translations and angular deflections between the plane of the sole of the shoe and the median plane of the blade;

the gap between the blade and the shoe is sufficiently narrow for the amount of flow of water that can flow away through it not to be such as to cause losses of efficiency of the flipper;

between the front part of the shoe and the blade a connection is made by means of purposely provided return members, i.e., elastomeric elastic tie-rods, which are able to exert a dynamic action of return between the two parts;

couplings for the rear end of the elastic tie-rods are provided, fixed to the front part of the rigid structure of the shoe, having the form of projections resembling hooks, located preferably on the left and on the right in the part farthest forward of the aforesaid rigid structure, if necessary positioned on parts protruding from the structure forwards towards the blade, said couplings being designed to engage the rear ring-shaped ends of the two return members, said connection being alternatively made according to any different morphology that will safeguard both the strength of the connection and, if need be, the possibility of rotation about a transverse axis passing through the two rings of the return members;

two front fulcra for coupling and rotation are provided for the front ends of the two return members, said fulcra being fixed to the blade in two symmetrical positions approximately at a distance of 3-25 cm further forward with respect to the corresponding couplings on the shoe, and with comparable distance between centres;

the return members are two longitudinal tie-rods made of elastomeric material, with the rear ends shaped in such a way as to be conveniently engaged to the two hooks on the shoe, for example, in the form of a simple ring or a ring reinforced by means of an internal thimble, and with the front ends shaped in such a way as to be able to engage, by means of respective pins, in said two fulcra of the blade; the parts involved—blade, shoe, rear couplings, front fulcra, return tie-rods—being shaped and made in such a way as not to present any interference during the cyclic movement of swimming, leaving to the tie-rods themselves the possibility of exerting their function of return by means of the simple axial tensile stress;

the tie-rods are not longitudinal but oblique or transverse and in any number, provided that they exert an action of return between the tip of the foot and the blade;

the return members are constituted by springs made of metal or plastic material, designed in any case to transmit tensile forces between the respective rear couplings and the front fulcra;

the return members are not elastic tie-rods but have a preset length, are mounted so as to enable an initial idle travel and to reach instantaneously end-of-travel when the blade reaches the maximum deflection allowed, said return members possibly being integrated with additional arrangements, such as for example cushioning elements, suitable for damping any jerks that are too severe;

the elastomeric material of said return members is chosen on the basis of its own capacity for absorbing deformations of elongation of any degree without retaining any memory thereof, returning each time, as the tensile stress vanishes exactly to the initial length, even for infinite cycles, said elastomeric material being silicone rubber or in any case vulcanized elastomer, which is able to store elastic energy and return it completely without any decrement due to permanent deformation of a plastic/viscous type;

the elastomeric material of the return members has a curve of elastic behaviour that in the first stretch follows the law of simple proportionality known as Hooke's law and then undergoes a sharp rise and becomes practically inextensible so as to prevent altogether any deflection of the blade greater than a clearly determined angular value;

a system is provided of a fast-adjustment type for initial tensioning of the tie-rods, for example a system in which the front end of the tensile members carry in themselves said pins, which in the blade find variable location in a finite series of notches, it being possible for said adjustment to be made easily by the swimmer, possibly also in the water and without requiring any tools;

the return members, or elastic tie-rods, are conveniently replaceable by the user himself for repair, if need be, or for being replaced with others having different elastic characteristics, possibly differentiated by means of different colourings;

instead of two return members there is provided a central one, or else more than two, or else single tie-rods but of more complex design in plan view, for example annular, U-shaped, triangular (with two points of engagement to the blade and one to the shoe or vice versa), polygonal or however devised, provided that they can transmit the flow of energy from the leg to the blade according to the three-fulcra kinematic and dynamic scheme of the invention;

the tensile effect of the tie-rods is not symmetrical in the two phases of kick-up and kick-down owing to a further action on the return tie-rods (for example, a pulley or a contrast element that rests on the two tie-rods during just one of the two actions) so as to differentiate the effect of return in the two phases, adapting the behaviour of the flipper to the natural asymmetry of the human motor during the action of swimming;

the structural connection between the blade and the shoe is obtained by means of the prolongation of the rear portion of the blade underneath the front portion of the sole of the shoe, without there being any constraint between the two parts before the blade arrives under the central or rear portion of the sole of the shoe, where there is the fixed-end joint between the shoe and the blade, in such a way as to enable the angular deflections between the shoe and the blade that are induced in the phase of kick-down, and elastic-return members are provided between the area surrounding the tip of the shoe and the front or central area of the blade;

the structural connection between the blade and the shoe is obtained by means of the prolongation of the rear portion of the blade on top of the front portion of the instep of the shoe, hence exonerating said area from any mechanical constraint, and sending the connection further backwards, on top of the central area of the foot or the attachment of the ankle, in such a way as to enable the angular defections between the blade and the shoe that are induced in the phase of kick-up, and elastic-return members are provided between the area surrounding the tip of the shoe and the front or central area of the blade;

the flipper can be described as a normal long flipper with full blade, from which: the portion of the blade corresponding to the first third facing the shoe has been removed, by means of a cut made to form a wide gap surrounding the front portion of the foot; the residual portion of the blade has been moved back towards the heel, without closing the void obtained by means of the cut; the connection between the blade and the shoe has been restored by means of the fixed-end connection, at the centre of the foot, of the two residual side protruding elements of the longitudinal members; thus obtaining the effect of approaching the centroid of the forces of resistance of the water to the hip, so reducing the arm of lever thereof, and leaving the portion of the blade perfectly free to assume wide angles of deflection with respect to the shoe; and elastic-return members have been provided between the area surrounding the tip of the shoe and the front or central area of the blade;

the rear margin of the blade and the front margin of the shoe, and possibly the two lateral margins alongside the front portion of the shoe, are connected by means of a flexible structure preferably made of elastomeric material and in any case shaped like a bellows or a membrane, designed to cover said gap, albeit enabling the mutual translation of the two parts and the corresponding angular deflections, without reducing to any determining extent the degrees of freedom of the system, this being done for aesthetic purposes or else for guaranteeing particular effects of completeness and homogeneity of the flow of water; and said elastic-return members are made using the same elastic materials used in the construction of the main parts of the flipper (such as, for example, the rubber of the shoe), and are preferably obtained by injection-moulding simultaneously with the moulding of the parts themselves.

Of course, the details of construction and the embodiments of the flipper may vary widely with respect to what is described and illustrated herein, without thereby departing from the scope of the present invention as defined in the ensuing claims.

The invention claimed is:

1. A flipper for swimming or underwater activities or muscular training, comprising:

a blade and a shoe, connected to the blade, in which the blade has a rear end facing the shoe and a front end opposite said shoe, and the shoe has a middle portion and a front part facing said rear end of the blade, said front part of the shoe and said rear end of the blade dynamically and kinematically separated from one another so as to avoid a transmission of forces and of relative movements in a direction substantially orthogonal to a plane of the blade;

said blade having lateral extensions projecting beyond said rear end of said blade so as to extend laterally alongside the shoe and said extensions connected to said middle portion of the shoe, said extensions fixedly connected to said blade from said rear end to said front end;

flexible tie rods elastically deformable under tensile forces and controlling angular variations between the blade and the shoe during swimming, said flexible tie rods connecting said blade to said front part of the shoe; and wherein a connection between said tie rods and said blade is adjustable so as to vary a pre-tensioning of said elastically deformable tie rods.

2. The flipper according to claim 1, wherein said tie rods are fixedly connected to said shoe.

3. The flipper according to claim 1, wherein said tie rods are connected to said shoe to allow articulation between said shoe and said tie rods.

4. The flipper according to claim 1, wherein said tie rods are detachable from said blade and said shoe without tools to allow a substitution of another set of interchangeable elastically deformable tie rods for said tie rods.

5. A flipper for swimming or underwater activities or muscular training, comprising:

a blade and a shoe, connected to the blade, in which the blade has a rear end facing the shoe and a front end opposite said shoe, and the shoe has a middle portion and a front part facing said rear end of the blade, said front part of the shoe and said rear end of the blade dynamically and kinematically separated from one another so as to avoid a transmission of forces and of relative movements in a direction substantially orthogonal to a plane of the blade;

said blade having lateral extensions projecting beyond said rear end of said blade so as to extend laterally alongside the shoe and said extensions connected to said middle portion of the shoe, said extensions fixedly connected to said blade from said rear end to said front end;

flexible tie rods elastically deformable under tensile forces and controlling angular variations between the blade and the shoe during swimming, said flexible tie rods connecting said blade to said front part of the shoe; and wherein said tie rods are provided with respective end rollers engaging pocket like seats arranged as a rack on said blade.

* * * * *

UNITED STATES PATENT AND TRADEMARK OFFICE

CERTIFICATE OF CORRECTION

PATENT NO. : 7,988,510 B2
APPLICATION NO. : 12/300881
DATED : August 2, 2011
INVENTOR(S) : Giovanni Battista Beltrani It is certified that error appears in the above-identified patent and that said Letters Patent is hereby corrected as shown below:

Error #1 (Title Page)
(22) PCT Filed: Delete "May 16, 2007" and insert --May 15, 2007--

Error #2
Claim 5, Column 22, Line 36, Delete "pocket like"

Signed and Sealed this
Fourth Day of October, 2011

David J. Kappos
*Director of the United States Patent and Trademark Office*